US009296539B2

(12) United States Patent
Wright et al.

(10) Patent No.: US 9,296,539 B2
(45) Date of Patent: Mar. 29, 2016

(54) VARIABLE DISPLACEMENT CONTAINER BASE

(71) Applicant: GRAHAM PACKAGING COMPANY, L.P., York, PA (US)

(72) Inventors: Paul Lee Wright, Aurora, IL (US); Justin A. Howell, Mecahnicsburg, PA (US); Travis A. Hunter, Hellam, PA (US); Romauld M. Philippe, York, PA (US); Michael T. Kelly, Manchester, PA (US); Robert Waltemyer, Felton, PA (US)

(73) Assignee: GRAHAM PACKAGING COMPANY, L.P., York, PA (US)

( * ) Notice: Subject to any disclaimer, the term of this patent is extended or adjusted under 35 U.S.C. 154(b) by 0 days.

(21) Appl. No.: 14/176,891

(22) Filed: Feb. 10, 2014

(65) Prior Publication Data

US 2014/0209558 A1 Jul. 31, 2014

Related U.S. Application Data

(63) Continuation of application No. PCT/US2014/011433, filed on Jan. 14, 2014.

(60) Provisional application No. 61/752,877, filed on Jan. 15, 2013, provisional application No. 61/838,166, filed on Jun. 21, 2013.

(51) Int. Cl.
*B65D 1/02* (2006.01)
*B65D 79/00* (2006.01)

(52) U.S. Cl.
CPC ..... *B65D 79/005* (2013.01); *B65D 1/0276* (2013.01)

(58) Field of Classification Search
CPC ..... B65D 79/005; B65D 1/0276
USPC ..... 220/609, 624; 215/373
See application file for complete search history.

(56) References Cited

U.S. PATENT DOCUMENTS

| | | | | |
|---|---|---|---|---|
| 5,139,162 | A | 8/1992 | Young et al. | |
| 6,585,123 | B1 * | 7/2003 | Pedmo et al. | 215/10 |
| 2003/0221987 | A1 * | 12/2003 | Trude | 206/508 |
| 2008/0047964 | A1 | 2/2008 | Denner et al. | |
| 2009/0090728 | A1 * | 4/2009 | Trude et al. | 220/609 |
| 2009/0159556 | A1 * | 6/2009 | Patcheak et al. | 215/373 |
| 2009/0242575 | A1 | 10/2009 | Kamineni et al. | |
| 2010/0219152 | A1 * | 9/2010 | Derrien et al. | 215/374 |
| 2011/0049083 | A1 * | 3/2011 | Scott et al. | 215/371 |
| 2013/0001235 | A1 | 1/2013 | Patcheak et al. | |

OTHER PUBLICATIONS

International Search Report and Written Opinion for PCT/US2014/011433, dated May 13, 2014.

* cited by examiner

*Primary Examiner* — Fenn Mathew
*Assistant Examiner* — Jennifer Castriotta
(74) *Attorney, Agent, or Firm* — Baker Botts L.L.P.

(57) ABSTRACT

Base includes an outer support wall, a support surface extending inwardly from the outer support wall and defining a reference plane, an inner support wall extending upwardly from the support surface, a first radiused portion extending radially inward from the inner support wall and concave relative to the reference plane, a second radiused portion extending radially inward from the first radiused portion and convex relative to the reference plane, an intermediate surface extending radially inward from the second radiused portion and substantially parallel to the reference plane, a third radiused portion extending radially inward from the intermediate surface and convex relative to the reference plane, and a central portion disposed proximate the third radiused portion.

24 Claims, 31 Drawing Sheets

300

200

100

600

500

400

VARIABLE DISPLACEMENT CONTAINER BASE

CROSS-REFERENCE TO RELATED APPLICATIONS

This application is a continuation of International Application No. PCT/US14/11433, filed Jan. 14, 2014, which claims priority to U.S. Provisional Application No. 61/752,877, filed Jan. 15, 2013, and U.S. Provisional Application No. 61/838,166, filed Jun. 21, 2013, the disclosure of each of which is incorporated by reference herein in its entirety.

BACKGROUND

Plastic containers, used for filling with juices, sauces etc., often are hot filled and then cooled to room temperature or below for distribution to sell. During the process of hot filling and quenching, the container is subjected to different thermal and pressure scenarios that can cause deformation, which may make the container non-functional or visually unappealing. Typically, functional improvements are added to the container design to accommodate the different thermal effects and pressures (positive and negative) that can control, reduce or eliminate unwanted deformation, making the package both visually appealing and functional for downstream situations. Functional improvements can include typical industry standard items such as vacuum panels and bottle bases to achieve the desired results. However, it is often desirable that these functional improvements, such as vacuum panels, are minimal or hidden to achieve a specific shape, look or feel that is more appealing to the consumer. Additional requirements may also include the ability to make the container lighter in weight but maintain an equivalent level of functionality and performance through the entire hot fill and distribution process.

Existing or current technologies such as vacuum panels in the side wall of the container may be unappealing from a look and feel perspective. Vacuum panels rely on different components to function efficiently and effectively. One of the major components of the efficiency includes the area in which the deformation to internal positive or negative pressure is controlled and/or hidden. Technologies that include a vacuum panel in the base portion are limited by surface area of the container and therefore the efficiency and effectiveness of the panel are likewise limited. Because of this, the shape and surface geometry that define the bottle's appearance, along with the potential to make the bottle lighter, are limited. In addition to surface area, another major factor in the performance of a vacuum panel can be its thickness distribution. Material thickness can play a vital role in how the panel responds to both positive and negative internal pressure. Through surface geometry however, the impact of material distribution can be greatly reduced providing a functional panel that performs consistently as it is intended with a wide process window. Thus there is a need to develop a base with specific surface geometries that utilize the limited base area to address the inconsistencies that are presented during the blow process specific to material distribution and the varying dynamics the container will be exposed to through the product lifecycle, as well as to expand the limits of the containers shape and/or weight while maintaining the functionality needed to perform as intended.

Furthermore, an additional factor for consideration in designing a container for use in a hot-fill application is the rate of cooling. For example, a hot-fill container filled at 180° F. generally must be cooled to at least about 90° F. in about 12-16 minutes for commercial applications. Therefore, a need exists for a container that can accommodate different rates of cooling. Preferably, such a container is capable of accommodating both negative pressures relative to the atmosphere due to such cooling as well as positive pressures due to changes in altitude or the like, internal pressure exerted during the hot-fill and capping process, as well as flexing to retain overall bottle integrity and shape during the cooling process.

SUMMARY

In accordance with certain embodiments of the disclosed subject matter, a base for a container is provided. The base includes an outer support wall, a support surface extending inwardly from the outer support wall and defining a reference plane, an inner support wall extending upwardly from the support surface, a first radiused portion extending radially inward from the inner support wall and concave relative to the reference plane, a second radiused portion extending radially inward from the first radiused portion and convex relative to the reference plane, an intermediate surface extending radially inward from the second radiused portion and substantially parallel to the reference plane, a third radiused portion extending radially inward from the intermediate surface and convex relative to the reference plane, and a central portion disposed proximate the third radiused portion.

Additionally, and as embodied herein, the central portion can include an inner core. The inner core can include a sidewall and a top surface extending from the sidewall. The top wall having a convex portion relative the reference plane. The base can further include a transition portion between the third radiused portion and the inner core.

Furthermore, and as embodied herein, the base can include a plurality of ribs extending from the central portion to the support surface and spaced apart to define a plurality of segments between the central portion and the support surface. The support surface can have a width of between about 4% to about 10% the width of the maximum cross-dimension of the base. At least an upper section of the inner support wall can extend inwardly at an angle of between about 15 degrees to about 85 degrees relative the reference plane.

In further embodiments according to the disclosed subject matter, the base additionally includes a fourth radiused portion disposed between the support surface and the inner support wall, and/or a fifth radiused portion disposed between the support surface and the outer support wall. Further in accordance with the disclosed subject matter, a container is provided having a sidewall and a base as disclosed above and in further detail below, wherein the base defines a diaphragm extending generally to the side wall. Further in accordance with the disclosed subject matter, a method of blow-molding such a container is provided.

BRIEF DESCRIPTION OF THE DRAWINGS

FIG. 11A is a bottom perspective view of the embodiment of FIGS. 7-9. FIG. 11B is a bottom perspective view of the embodiment of FIGS. 4-6. FIG. 11C is a bottom perspective view of the embodiment of FIGS. 1-3.

FIG. 23A is a bottom perspective view of the embodiment of FIG. 21. FIG. 23B is a bottom perspective view of the embodiment of FIG. 20. FIG. 23C is a bottom perspective view of the embodiment of FIG. 18.

DETAILED DESCRIPTION

Figure 1:
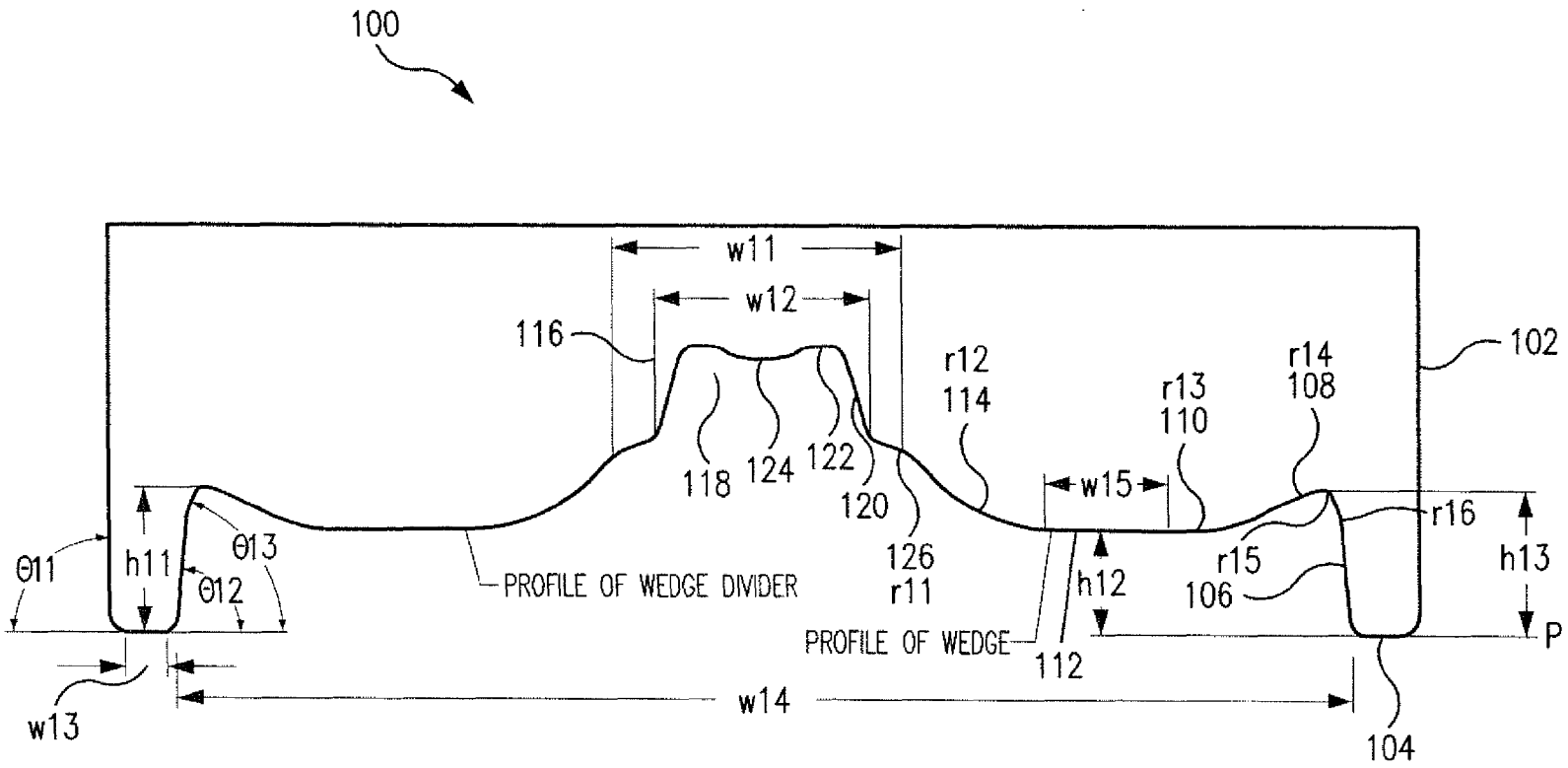
FIG. 1 is a front, cross-sectional schematic view of an exemplary embodiment of the base.

The apparatus and methods presented herein may be used for containers, including plastic containers, such as plastic containers for liquids. The containers and bases described herein can be formed from materials including, but not limited to, polyethylene terephthalate (PET), polyethylene naphthalate (PEN) and PEN-blends, polypropylene (PP), high-density polyethylene (HDPE), and can also include monolayer blended scavengers or other catalytic scavengers as well as multi-layer structures including discrete layers of a barrier material, such as nylon or ethylene vinyl alcohol (EVOH) or other oxygen scavengers. The disclosed subject matter is particularly suited for hot-fillable containers having a base design that is reactive to internal and external pressure due to pressure filling and/or due to thermal expansion from hot filling to provide controlled deformation that preserves the structure, shape and functionality of the container. The container base can also provide substantially uniform controlled deformation when vacuum pressure is applied, for example due to product contraction from product cooling.

In accordance with the disclosed subject matter herein, the disclosed subject matter includes a base for a container having a sidewall. The base includes a support surface defining a reference plane, an inner wall extending upwardly from the support surface, a first radiused portion extending radially inward from the inner wall and concave relative to the reference plane, a second radiused portion extending radially inward from the first radiused portion and convex relative to the reference plane, an intermediate surface extending radially inward from the second radiused portion and substantially parallel to the reference plane, a third radiused portion extending radially inward from the inner surface and convex relative to the reference plane, and an inner core disposed proximate the third radiused portion to define a central portion of the base. The base can also include an outer support wall, which can be an extension of the container side. In additional embodiments in accordance with the disclosed subject matter, the base further includes a fourth radiused portion disposed between the support surface and the inner support wall, and/or a fifth radiused portion disposed between the support surface and the outer support wall. As described further below, each radiused portion defines a hinge for relative movement therebetween, such that at least a portion of the base acts as a diaphragm.

Reference will now be made in detail to the various exemplary embodiments of the disclosed subject matter, exemplary embodiments of which are illustrated in the accompanying drawings. The structure of the base for the container of the disclosed subject matter will be described in conjunction with the detailed description of the system.

The accompanying figures, where like reference numerals refer to identical or functionally similar elements throughout the separate views, serve to further illustrate various embodiments and to explain various principles and advantages all in accordance with the disclosed subject matter. For purpose of explanation and illustration, and not limitation, exemplary embodiments of the base and container with the disclosed subject matter are shown in the accompanying figures. The base is suitable for the manufacture of containers such as, bottles, jars and the like. Such containers incorporating the base can be used with a wide variety of perishable and non-perishable goods. However, for purpose of understanding, reference will be made to the use of the base for a container disclosed herein with liquid or semi-liquid products such as sodas, juices, sports drinks, energy drinks, teas, coffees, sauces, dips, jams and the like, wherein the container can be pressure filled with a hot liquid or non-contact (i.e., direct drop) filler, such as a non-pressurized filler, and further used for transporting, serving, storing, and/or re-using such products while maintaining a desired shape, including providing a support surface for standing the container on a table or other substantially flat surface. Containers having a base described herein can be further utilized for sterilization, such as retort sterilization, and pasteurization of products contained therein. As described in further detail below, the container can have a base configuration to provide improved sensitivity and controlled deformation from applied forces, for example resulting from pressurized filling, sterilization or pasteurization and resulting thermal expansion due to hot liquid contents and/or vacuum deformation due to cooling of a liquid product filled therein. The base configuration can influence controlled deformation from positive container pressure, for example resulting from expansion of liquid at increased temperatures or elevations. For purpose of illustration, and not limitation, reference will be made herein to a base and a container incorporating a base that is intended to be hot-filled with a liquid product, such as tea, sports drink, energy drink or other similar liquid product.

Figure 2A:
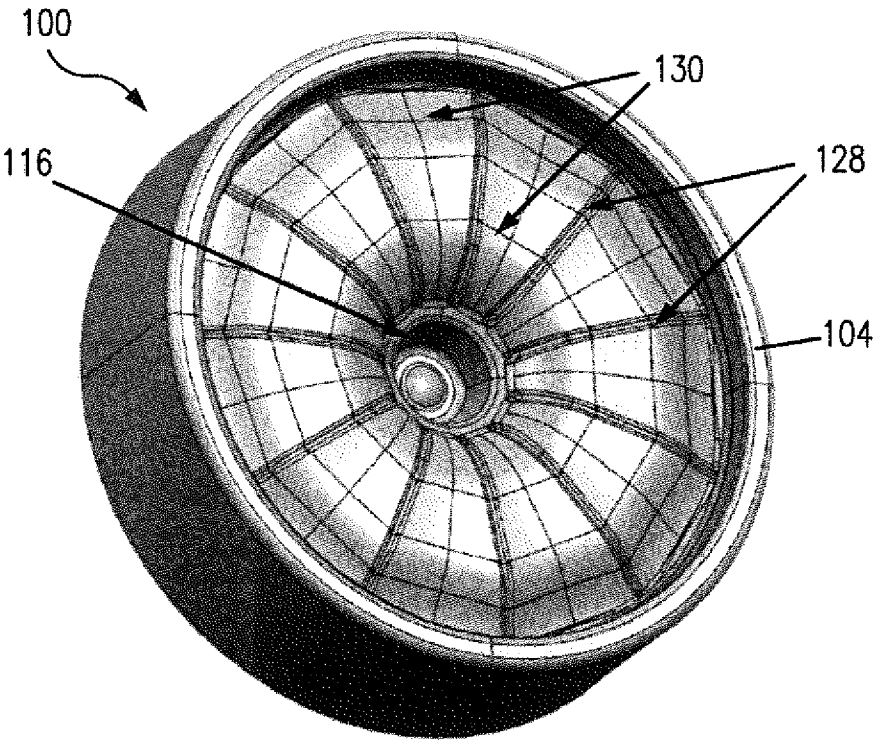
FIG. 2A is a bottom left perspective view of the exemplary embodiment of FIG.
Figure 2B:
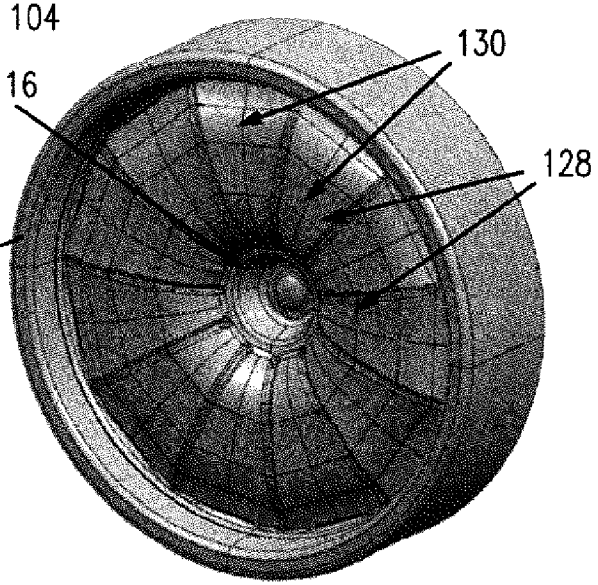
FIG. 2B is a bottom right perspective view of the exemplary embodiment of FIG. 1.
Figure 2C:
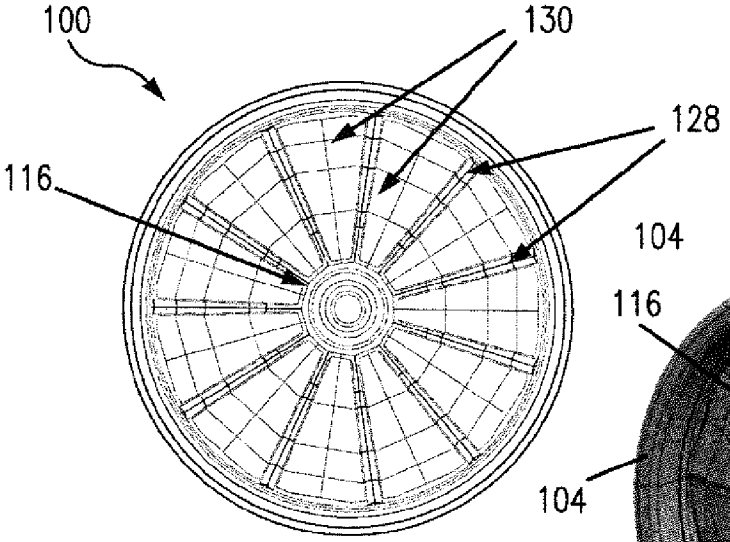
FIG. 2C is a bottom plan view of the exemplary embodiment of FIG. 1.
Figure 3:
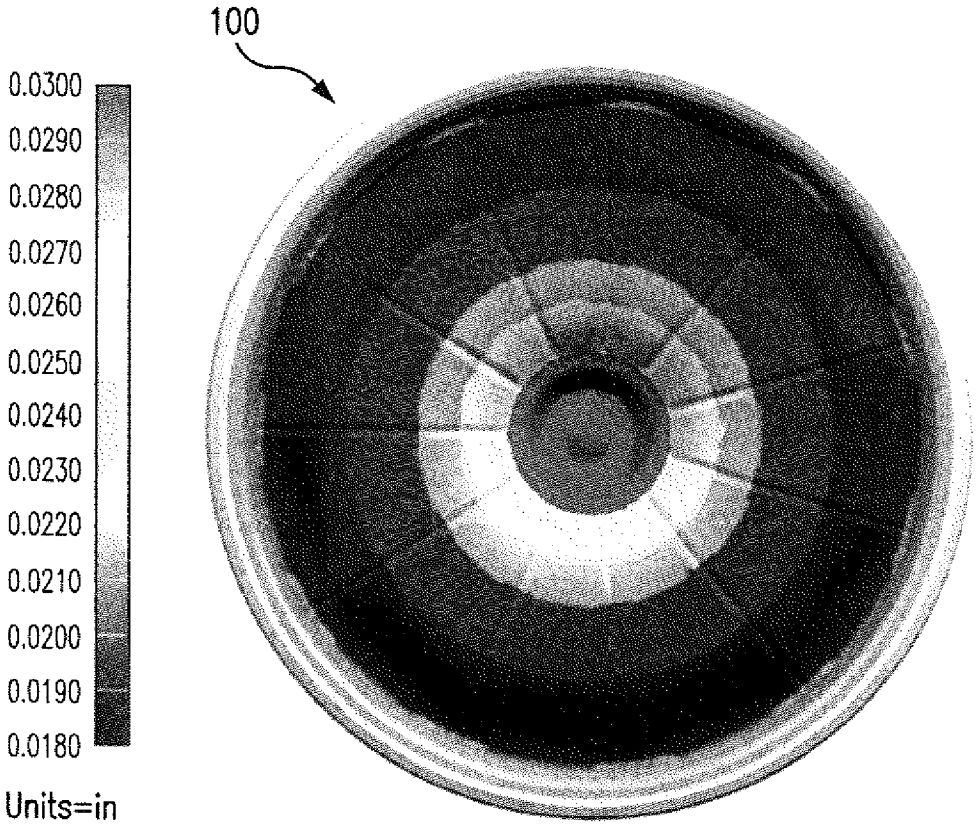
FIG. 3 is a bottom view of the exemplary embodiment of FIG. 1, illustrating the thickness of the base at various points.

FIGS. 1-3 illustrate exemplary embodiments of the disclosed subject matter. With reference to FIG. 1, the base 100 generally defines a diaphragm including a series of radiused portions. The multiple radiused portions can allow the base 100 to deform a desired manner from circumferential stress concentrations. As shown in FIG. 2A-3, the base 100 generally can include any number of radial segments between the radiused portions to proportionally distribute the force differential between the inside and outside of the container to provide a low spring rate, that is change in resistance due to pressure change.

As shown for example in FIGS. 1-3, the base 100 can include an outer support wall 102, a support surface 104 extending inwardly from the outer support wall 102 and defining a reference plane P, and an inner support wall 106 extending upwardly from the support surface 104. In accordance with the disclosed subject matter, a first radiused portion 108 extends radially inward from the inner support wall 106 and concave relative to the reference plane P. A second radiused portion 110 extends radially inward from the first radiused portion 108 and convex relative to the reference plane P. An intermediate surface 112 extends radially inward from the second radiused portion 110 and substantially parallel to the reference plane P. A third internal radiused portion 114 extends radially inward from the intermediate surface 112 and convex to the reference plane P to a central portion 116. The intermediate surface 112 can be substantially flat or linear in shape, and can extend at an angle substantially parallel (i.e., +/−10 degrees) relative to the reference plane P.

The central portion 116 can be configured to form a variety of suitable shapes and profiles. For example, and as depicted, the central portion 116 can be provided with an inner core 118. The inner core 118 can have a generally frustoconical shape or the like and can be shallow or deep as desired. By way of example, the inner core 118 can comprise a sidewall 120 and a top surface 122 extending from the sidewall 120, the top surface 122 having a convex portion 124 relative to the reference plane P.

As further defined herein, the radiused portions generally function as hinges to control at least in part the dynamic movement of the base 100. For example, the first radiused portion 108 can be configured as a primary contributor to both the ease with which the base 100 deforms and the amount of deformation. With reference to the exemplary embodiments disclosed in FIG. 1, the second and third radiused portions 110, 114 can cooperate with the first radiused portion 108 and provide for additional deformation, such as approximately 10-20% or more of total base displacement.

Each radiused portion can be configured to deform in conjunction with the other. For example, a change to the geometry and/or relative location of either of the third radiused portion 114 or second radiused portion 110 can affect the deformation response of the first radiused portion 108. As described further below, a transition portion 126 between the third radiused portion 114 and the inner core 118 can also be configured to affect the efficiency or response of the base deformation. Furthermore, the length of the intermediate surface 112 can be selected to affect such deformation based upon its relationship with the second and third radiused portions 110, 114. In this manner a diaphragm can be designed and tailored based upon the interactions of these base portions to provide a desired performance and affect.

In addition to the profile of the base 100 as defined by the radiused portion locations, the radius of the transition portion 126 between the inner core 118 and the third radiused portion 114, as well as the conical shape of the inner core 118, can be modified to increase or decrease the spring rate or response to pressure differentials, which can accommodate a range of the thermodynamic environments, such as variations in hot-fill filling lines. The base profile can also allow the base 100 to be scaled to containers of different overall shapes such as oval, square or rectangular shapes and different sizes while maintaining consistent thermal and pressure performance characteristics.

The overall design and contour of the base profile, or a portion thereof, can act as a diaphragm responsive to negative internal pressure or vacuum as well as positive internal pressure. The diaphragm can aid in concentrating and distributing axial stress. With reference to the exemplary embodiment of FIG. 1-3, the effective area of the diaphragm can be measured as the portion of the base extending diametrically from the top of the inner support wall 106 on one side of the container to the top of the inner support wall 106 on the opposite side. The differential in pressure between the inside of the container and outside of the container can flex the base 100 in a controlled manner. The concentration of stress can be rapidly distributed to radiate outwardly from the center of the base 100 in a uniform circumferential manner. The stress concentrations in the base thus can be directed circumferentially at or around the radiused portions in the diaphragm plane and extend out in a wave manner.

FIGS. 2A-2B show a bottom left perspective and bottom right perspective view, respectively, of the exemplary embodiment of FIG. 1. FIG. 2C shows a bottom plan view of the exemplary embodiment of FIG. 1. FIG. 3 shows a bottom view of the exemplary embodiment of FIG. 1, illustrating the thickness of the base 100 at various points. With reference to FIGS. 2A-3, the base design can further include ribs 128 to form base segments 130 that can cooperate with the radial radiused portions to improve strength and resistance to deformation or roll out from positive pressure. The geometry of the ribs 128 that divide the segments 130 can provide support to the base 100 as it radiates out to the support surface 104. The base 100 can deform more efficiently without the segments 130 when only internal vacuum is considered. However through testing it was determined that the use of the segments 130 can further prevent the base 100 from deforming in an uncontrolled manner and/or to an unrecoverable state, and thus provides a structural support response to internal positive pressure caused by thermal expansion during the filling and capping process which ultimately results in predicted/controlled and improved response to vacuum. Thus, while typical prior art container base vacuum panel technology focuses on the performance of the panel in response to a vacuum (i.e., negative pressure), embodiments disclosed herein can further address performance of the panel in response to the positive pressure exerted during filling and capping.

Figure 26:
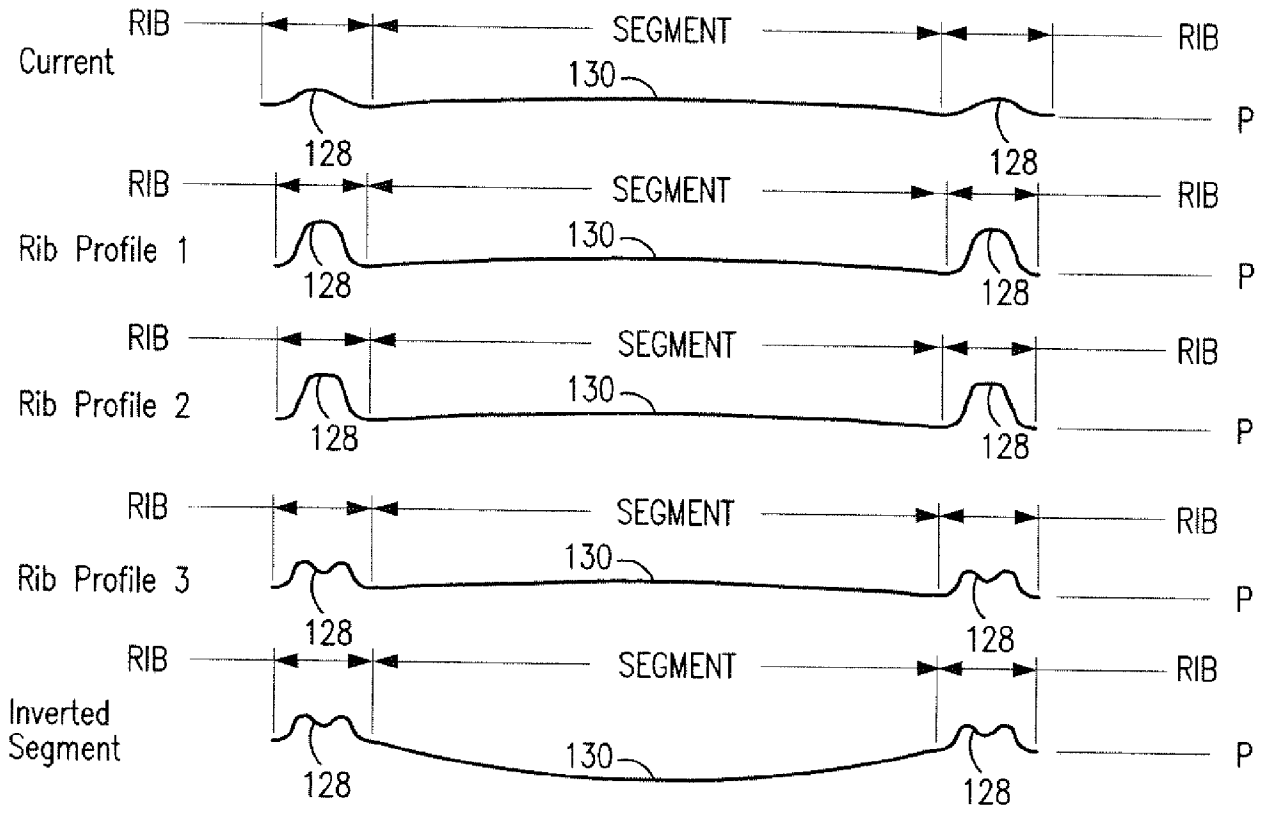
FIG. 26 is a front, cross-sectional schematic view of exemplary bases illustrating exemplary rib profiles, for purpose of comparison, in accordance with the disclosed subject matter.

Further in accordance with the disclosed subject matter, the base, and thus the container, can be configured with any of a variety of different shapes, such as a faceted shape, a square shape, oval shape (see FIG. 4) or any other suitable shape. In this manner, each segment 130, if provided, can be formed as a wedge and can serve as a discrete segment of the base. The segment can have a profile that matches the base profile of FIG. 1 when viewed in that direction. When viewing the cross section of the segment as it extends radially out from the center longitudinal axis, each segment can have a convex or concave shape relative to the reference plane P as in FIG. 26. A segment 130 that is convex-shaped when referring to the reference plane P can create small regions that can invert displacing volume in the presence of vacuum. As such, volume displacement can be reduced relative to the entire base or diaphragm structure movement. A segment 130 that is concave-shaped relative to the reference plane P can improve control of deformation from internal pressure. The concave shape can further control total base movement. The ribs 128 dividing the base 100 can further support or tie the base together circumferentially. The ribs 128 can be formed continuously along the base 100 from the inner core 118 to the support surface 104. Alternatively, the ribs 128 can be formed with discontinuities, for example having discontinuities along the base 100 at the points where any or all of the radiused portions are formed. In addition, the rib cross section as viewed in FIG. 26 can have varying shapes and sizes as defined in FIG. 26.

The base segments 130 can each function independently to provide variable movement of the base 100 and can result in displacement in response to small changes in internal or external changes in container pressure. The combined structure of the individual segments 130 and the ribs 128 dividing the segments 130 can reduce the reaction or displacement to positive pressure while increasing or maintaining sensitivity to negative internal pressure. The base segments 130 can move independently in response to the force or rate of pressure change. Thus, each base segment 130 or area within the segment can provide a secondary finite response to vacuum deformation and product displacement. As such, the combination of segments 130 and dividing ribs 128 can adapt or compensate to variations in wall thicknesses and gate locations among containers formed using base 100 that would otherwise cause inconsistent or incomplete base movement as found in the control. The movement of the segments can be secondary to primary movement or deflection of the overall base diaphragm structure, which can be affected by the base geometry and radiused portions, as described herein.

Current and earlier base technologies have also used mechanical actuation as a method to compensate for product contraction. These technologies have incorporated segments or scallops as part of the design of the base, and in these particular instances, the segments—and specifically the area in between the segments—were needed to provide uniform base movement as the base was mechanically inverted. To achieve this, the area between the segments flex or deform to maintain the shape of the segment and maximize the volume displaced by inversion as all the segments around the circumference of the base invert consistently. Without these breaks in the geometry, the base could invert in an uneven and uncontrolled manner. In the case of the present variable displacement base, the segments 130, either concave or convex in shape when viewing the cross section from the central longitudinal axis out to the major diameter, can react individually as a response to either internal positive or negative pressure. The deformation that occurs reacts in the actual segment surface as opposed to the area in between the segment. It is through this action that the segments 130 can respond individually such that base 100 can respond dynamically to multiple forces and maintain consistent total base deformation.

In this manner, base 100 can respond or deform in a controlled manner from the positive internal pressure. The controlled deformation can prevent the base diaphragm region from extending down past the standing ring, which may define reference plane P or support surface 104, while providing a geometry that can respond dynamically to internal vacuum pressure. Base 100 can exhibit a small degree of relaxation or thermal creep due to hot fill temperatures and the resulting positive pressure from thermal expansion within the container. The environmental effect of temperature, pressure and time can interact with base 100 to provide a controlled deformation shape. Due at least in part to the response of the material to heat and pressure, some elastic hysteresis can prevent base 100 from returning to its original molded shape when all forces are removed. It was discovered through analysis and physical testing that the design of the base profile, segments 130 and ribs 128 would lead to an initial surface geometry that, when subjected to the positive pressure of hot filling and capping, results in a shape that also responds efficiently to internal vacuum pressures. Thus, after hot filling and capping, the resulting shape of base 100 can be considered a preloaded condition from which the bottle base can be designed to respond to vacuum deformation from the negative internal pressure created by product contraction during cooling.

Figure 4:
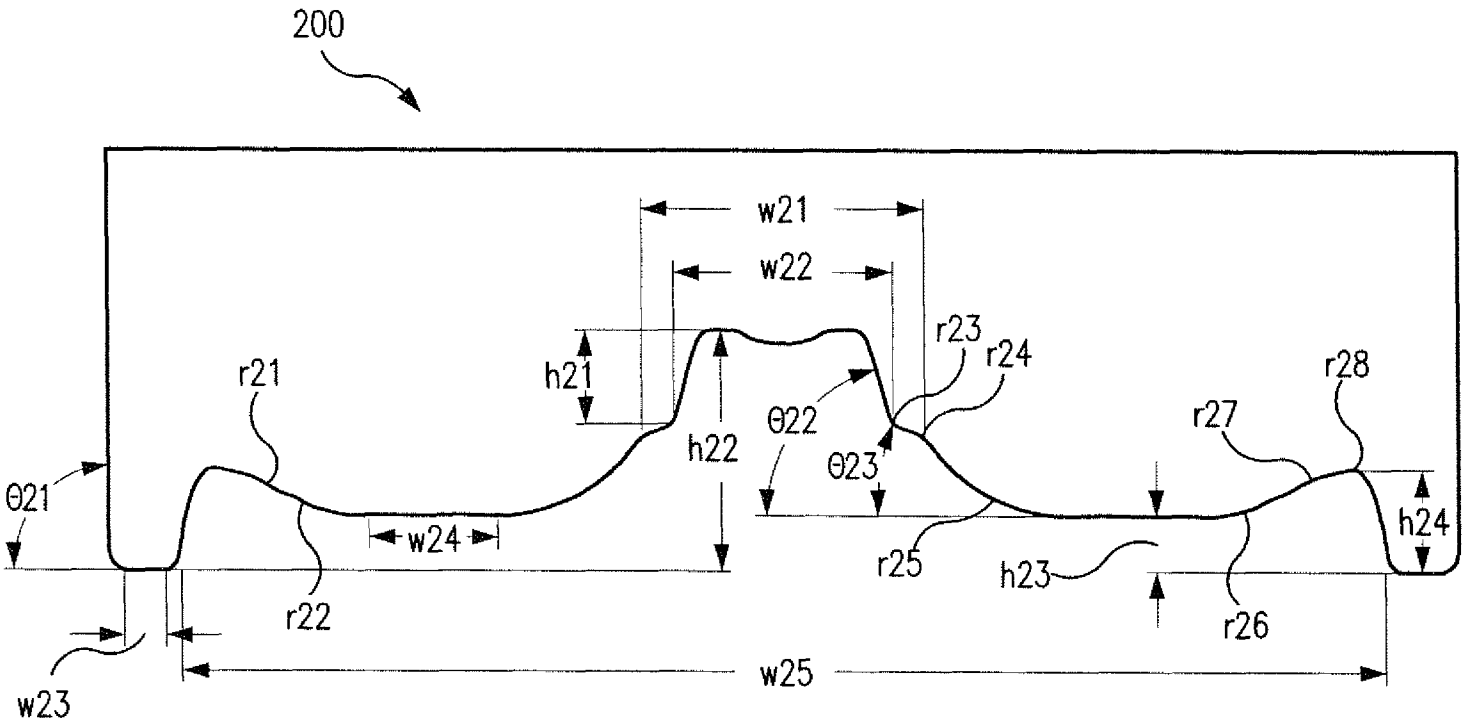
FIG. 4 is a front, cross-sectional schematic view of another exemplary embodiment of a base in accordance with the disclosed subject matter.
Figure 5:
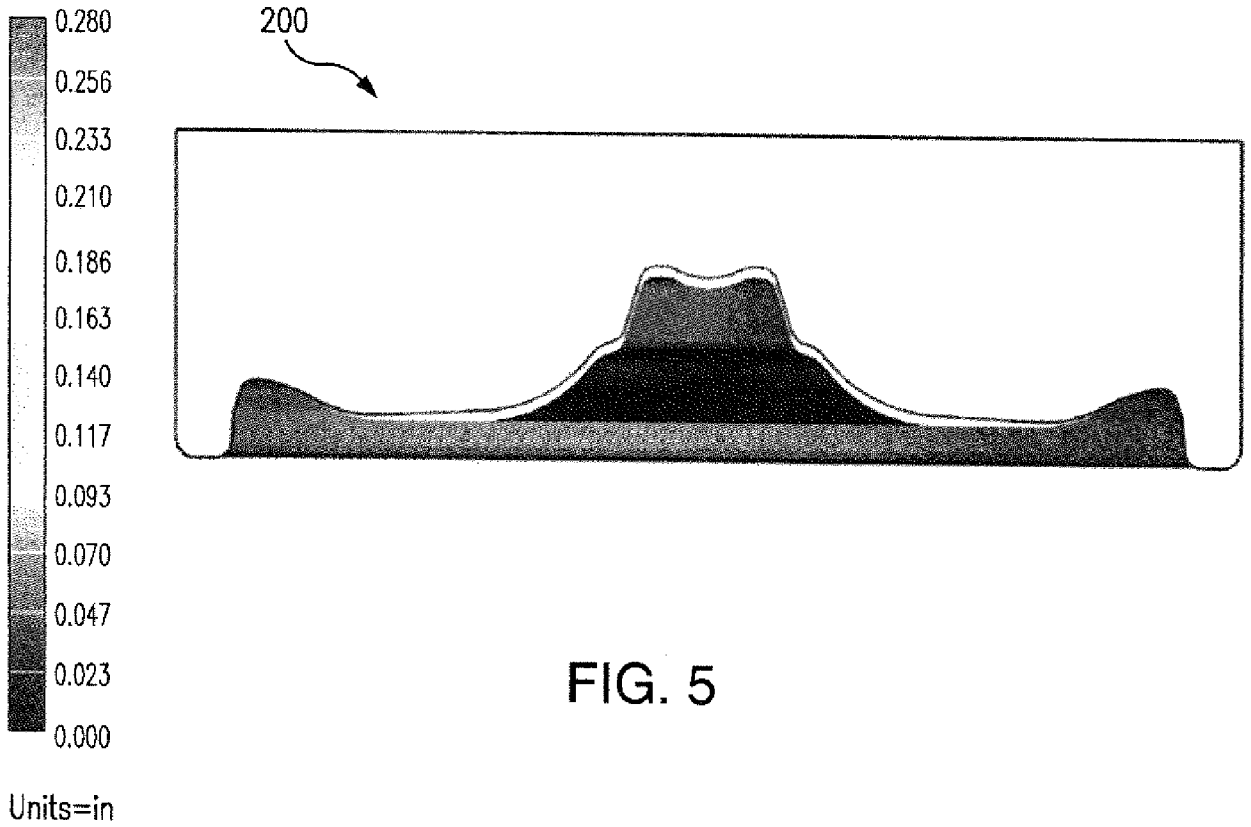
FIG. 5 is a front, cross-sectional schematic view illustrating additional features of the exemplary embodiment of FIG. 4.
Figure 6:
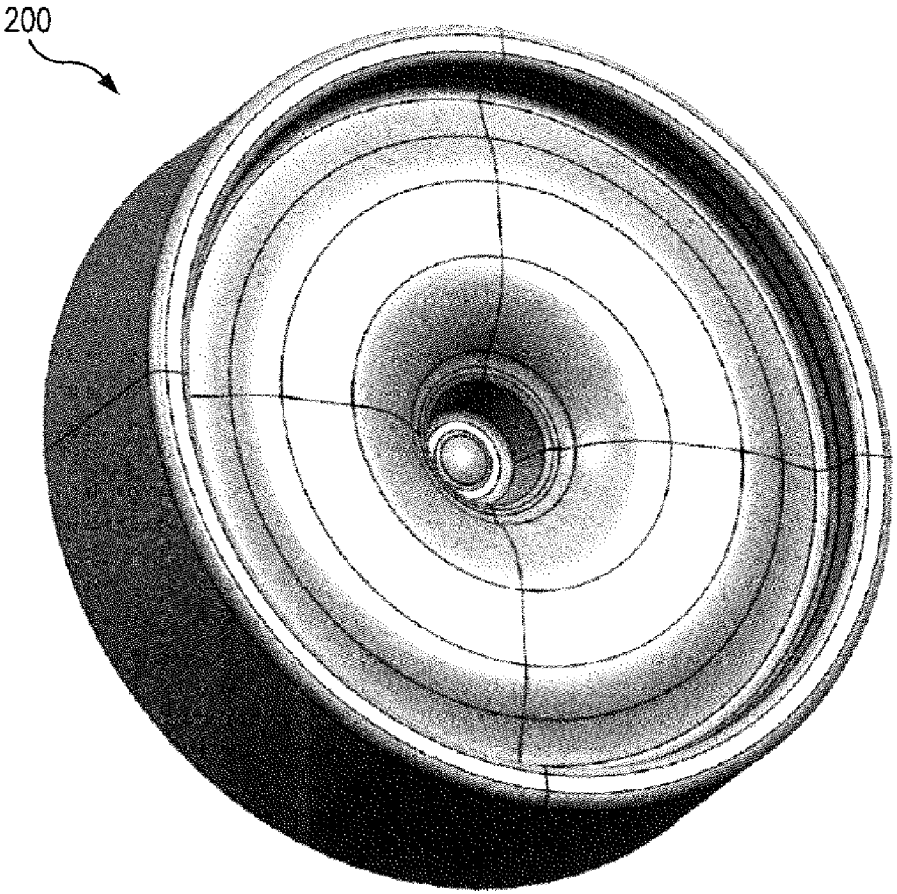
FIG. 6 is a bottom perspective view of the exemplary embodiment of FIG. 4.

Using the base profile as disclosed, a variety of embodiments can be configured as depicted in the figures, for purpose of illustration and not limitation. For example, FIGS. 4-6 illustrate an exemplary embodiment of a base 200 in accordance with the disclosed subject matter, shown without ribs, and having different dimensions. FIGS. 4 and 5 each shows a front, cross-sectional schematic view of the exemplary embodiment of base 200. FIG. 6 shows a bottom perspective view of the exemplary embodiment of base 200.

Figure 7:
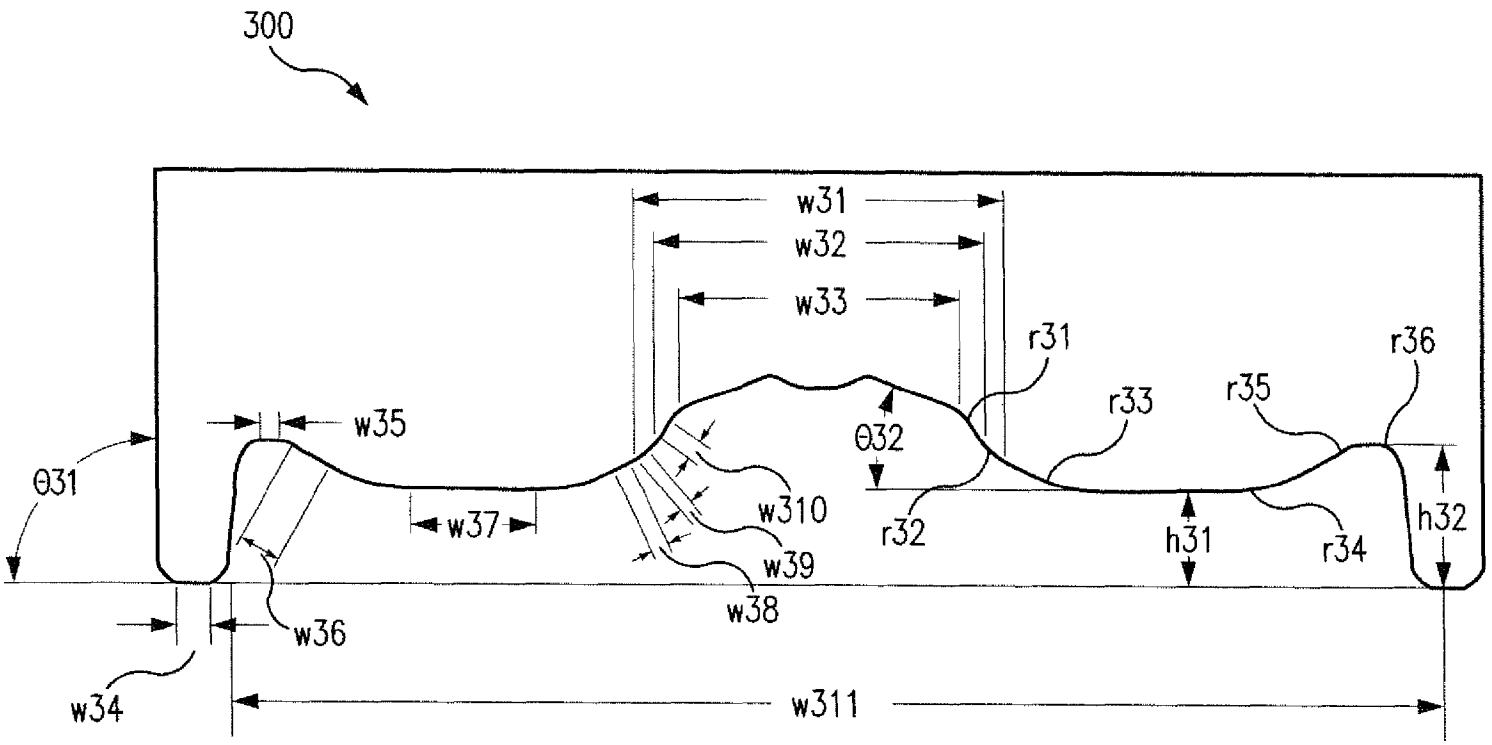
FIG. 7 is a front, cross-sectional schematic view of another exemplary embodiment of a base in accordance with the disclosed subject matter.
Figure 8:
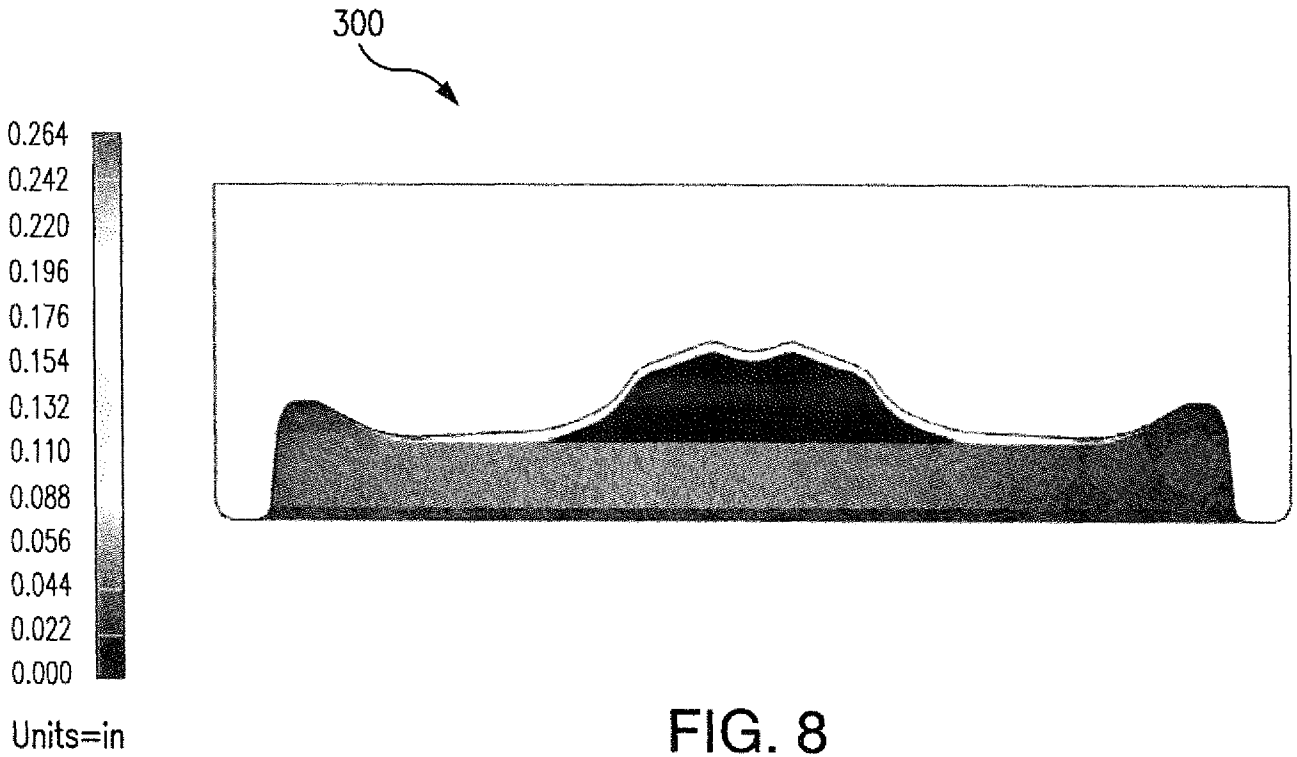
FIG. 8 is a front, cross-sectional schematic view illustrating additional features of the exemplary embodiment of FIG. 7.
Figure 9:
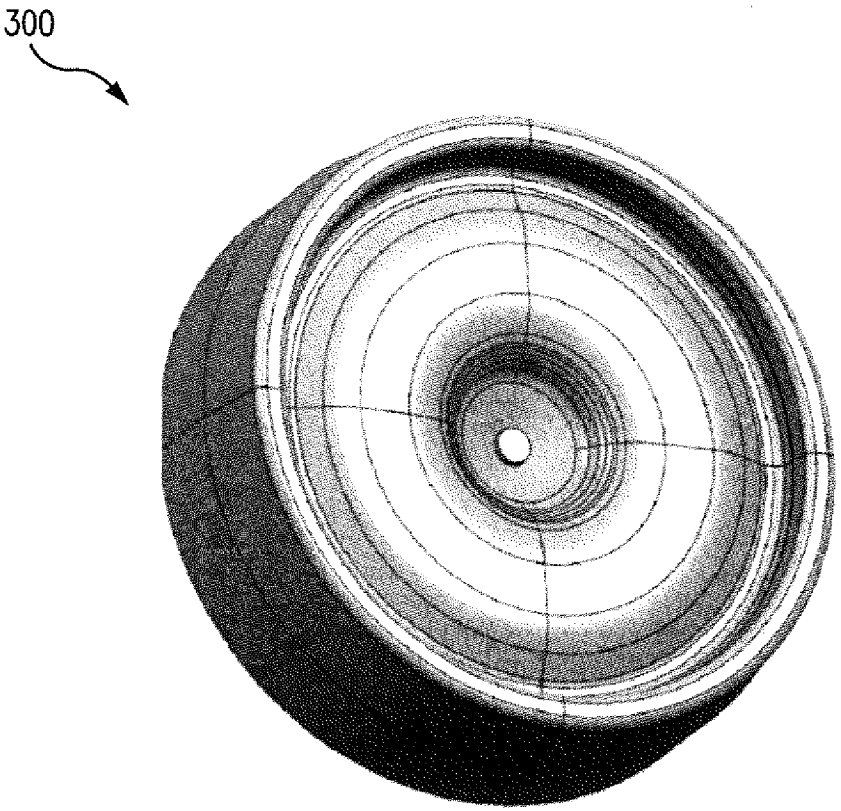
FIG. 9 is a bottom perspective view of the exemplary embodiment of FIG. 7.

FIGS. 7-9 illustrate another exemplary embodiment of a base 300 in accordance with the disclosed subject matter having different dimensions. FIGS. 7 and 8 each shows a front, cross-sectional schematic view of the exemplary embodiment of the base 300. FIG. 9 shows a bottom perspective view of the exemplary embodiment of base 300.

Figure 10:
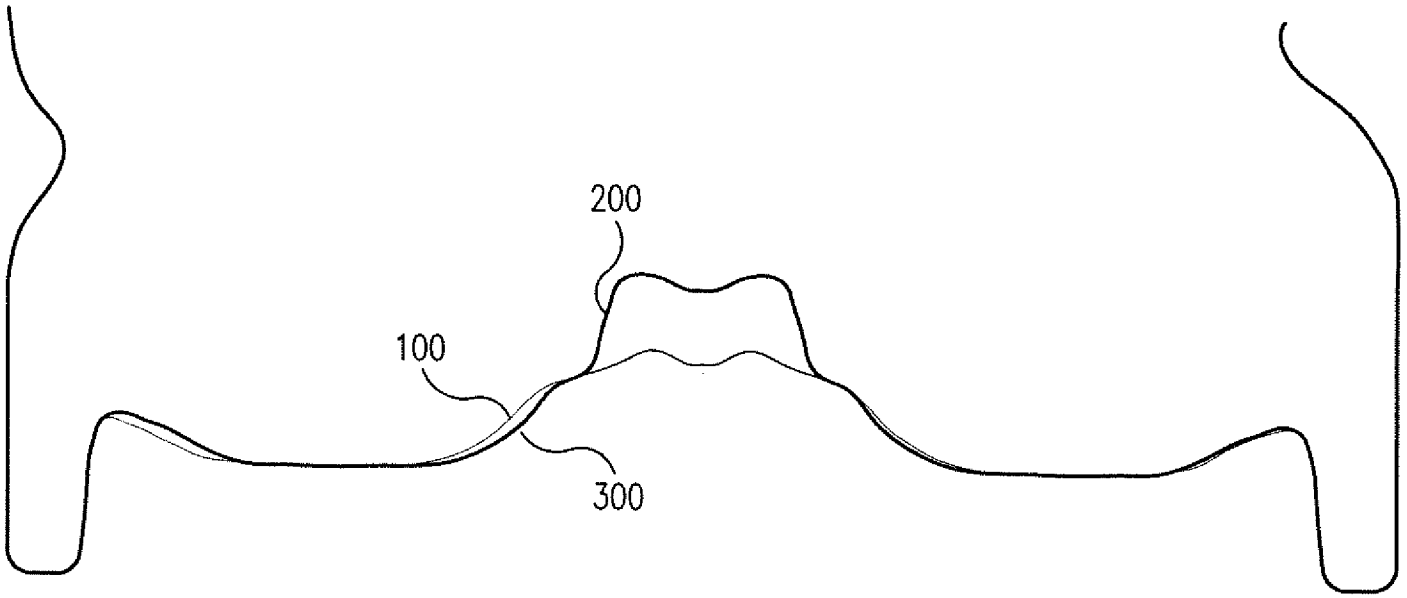
FIG. 10 is a front, cross-sectional schematic view of each of the exemplary embodiments of FIGS. 1-9 overlaid on each other, for purpose of comparison.
Figure 11A:
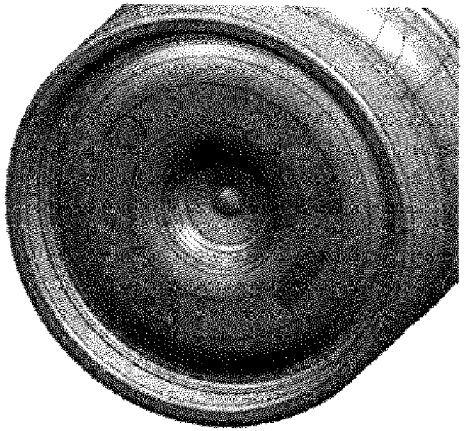
FIGS. 11A-11C each is a bottom perspective view of one of the exemplary embodiments of FIGS. 1-9, shown side-by-side for purpose of comparison.
Figure 11B:
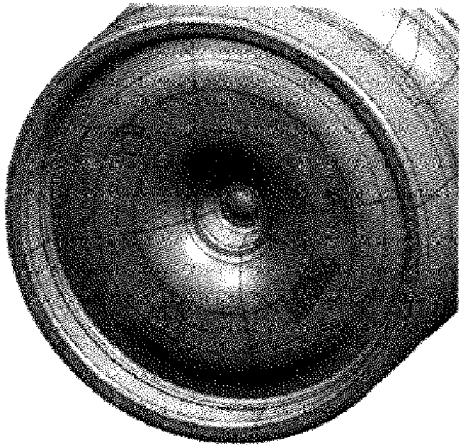
Figure 11C:
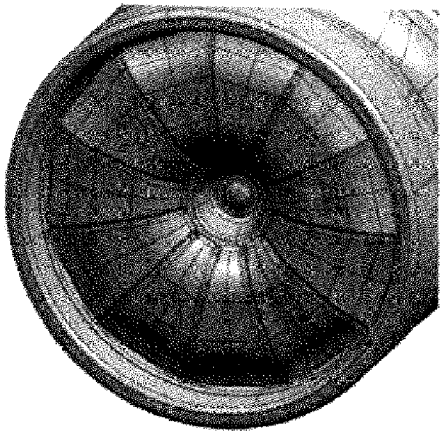

FIG. 10 shows front, cross-sectional schematic views of the exemplary embodiments of FIGS. 1-9 overlaid on each other, for purpose of comparison. FIGS. 11A-11C show bottom perspective views of the exemplary embodiments of FIGS. 1-9 side-by-side for purpose of comparison. FIG. 11A shows a bottom perspective view of the embodiment of FIGS. 7-9. FIG. 11B shows a bottom perspective view of the embodiment of FIGS. 4-6. FIG. 11C shows a bottom perspective view of the embodiment of FIGS. 1-3.

Figure 12:
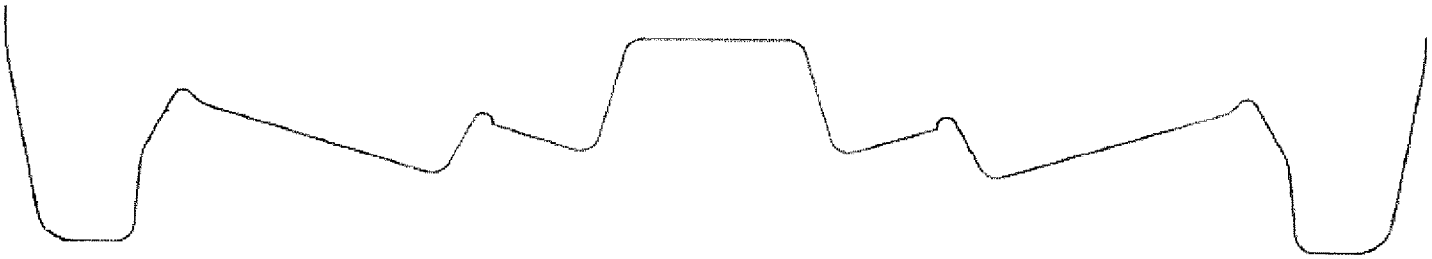
FIG. 12 Prior Art
FIG. 12 is a cross-sectional schematic view of a known, current base for a container, for purpose of comparison to the exemplary embodiments of the disclosed subject matter.
Figure 13:
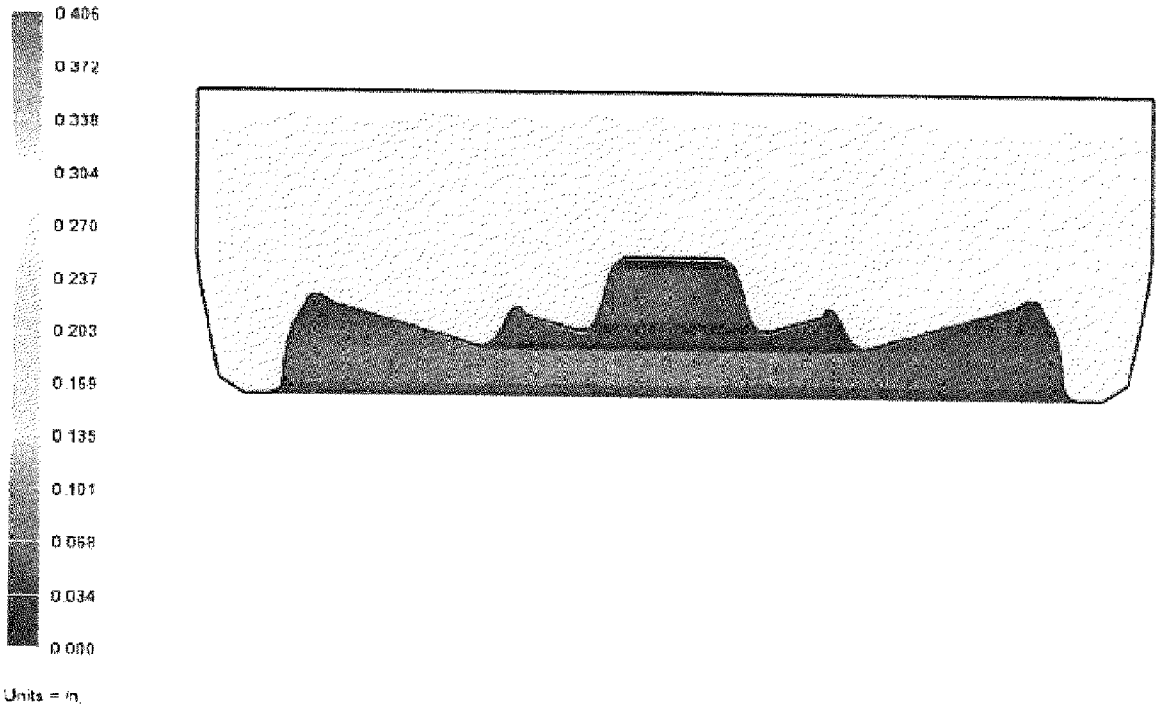
FIG. 13 Prior Art
FIG. 13 is a cross-sectional schematic view of another known, current base for a container, for purpose of comparison to the exemplary embodiments of the disclosed subject matter.
Figure 14:
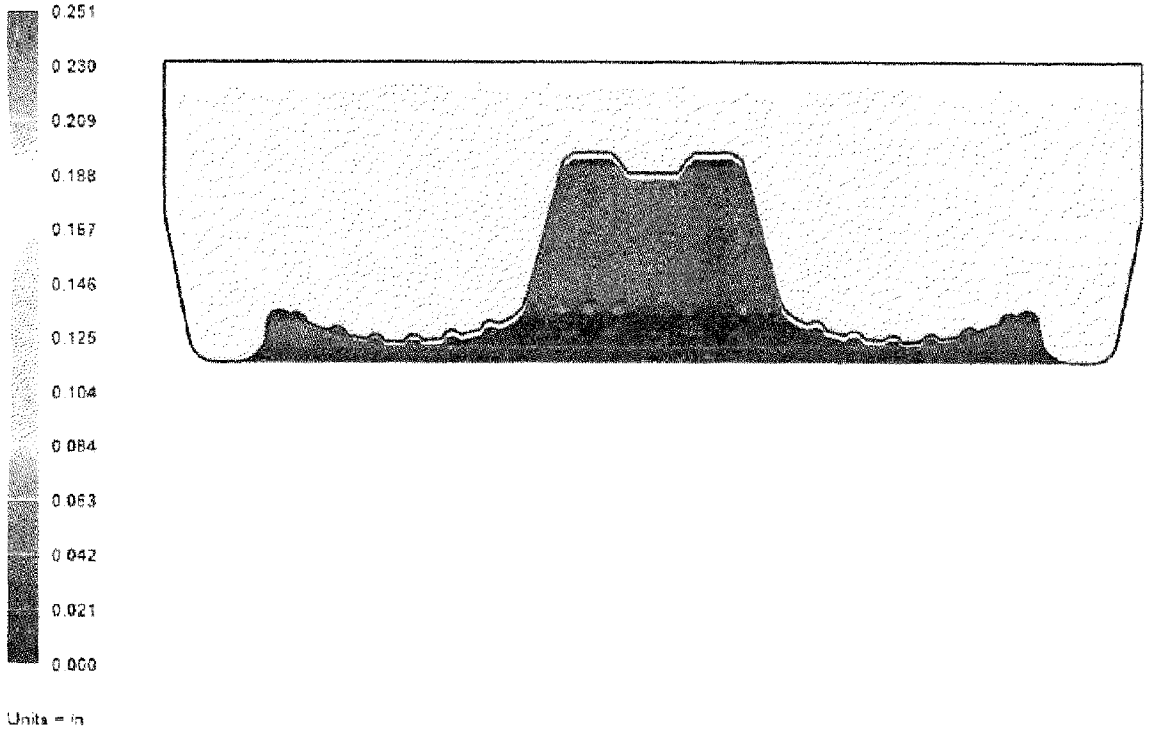
FIG. 14 Prior Art
FIG. 14 is a front, cross-sectional schematic view of another known, competitive base for a container, for purpose of comparison to the exemplary embodiments of the disclosed subject matter.

FIGS. 12 and 13 show cross-sectional schematic views of a known, current base for a container, for purpose of comparison to the exemplary embodiments of the disclosed subject matter. FIG. 14 shows a front, cross-sectional schematic view of a known, competitive base for a container, for purpose of comparison to the exemplary embodiments of the disclosed subject matter.

Figure 15:
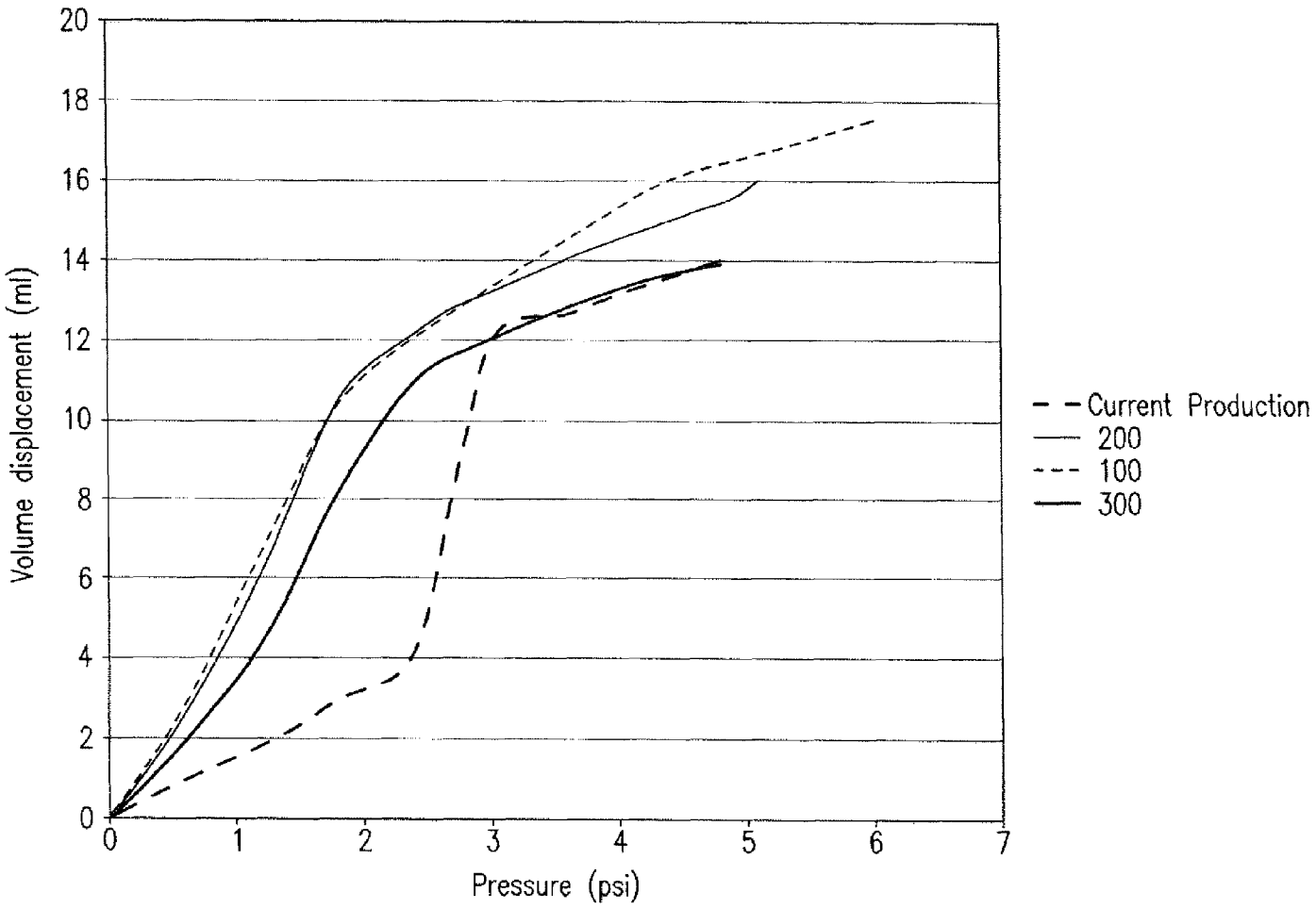
FIG. 15 is a graph illustrating the volume displacement response over a range of pressures for each of the embodiments of FIG. 1, FIG. 4 and FIG. 7 as compared to the known current base of FIG. 12.

For purpose of understanding and not limitation, a series of graphs are provided to demonstrate various operational characteristics achieved by the base and container disclosed herein. FIG. 15 shows a graph illustrating the volume displacement response over a range of pressures for the embodiments of FIG. 1 (ref. 100), FIG. 4 (ref. 200) and FIG. 7 (ref. 300) as compared to the known current base of FIG. 12 (ref. Current Production). FIG. 15 illustrates a simulated volume displacement of each base increasing from an initial reference position over a range of applied vacuum pressure. As shown in FIG. 15, the embodiments of the disclosed subject matter exhibit a relatively uniform, linear displacement under applied vacuum pressure compared to the known current base.

Figure 16:
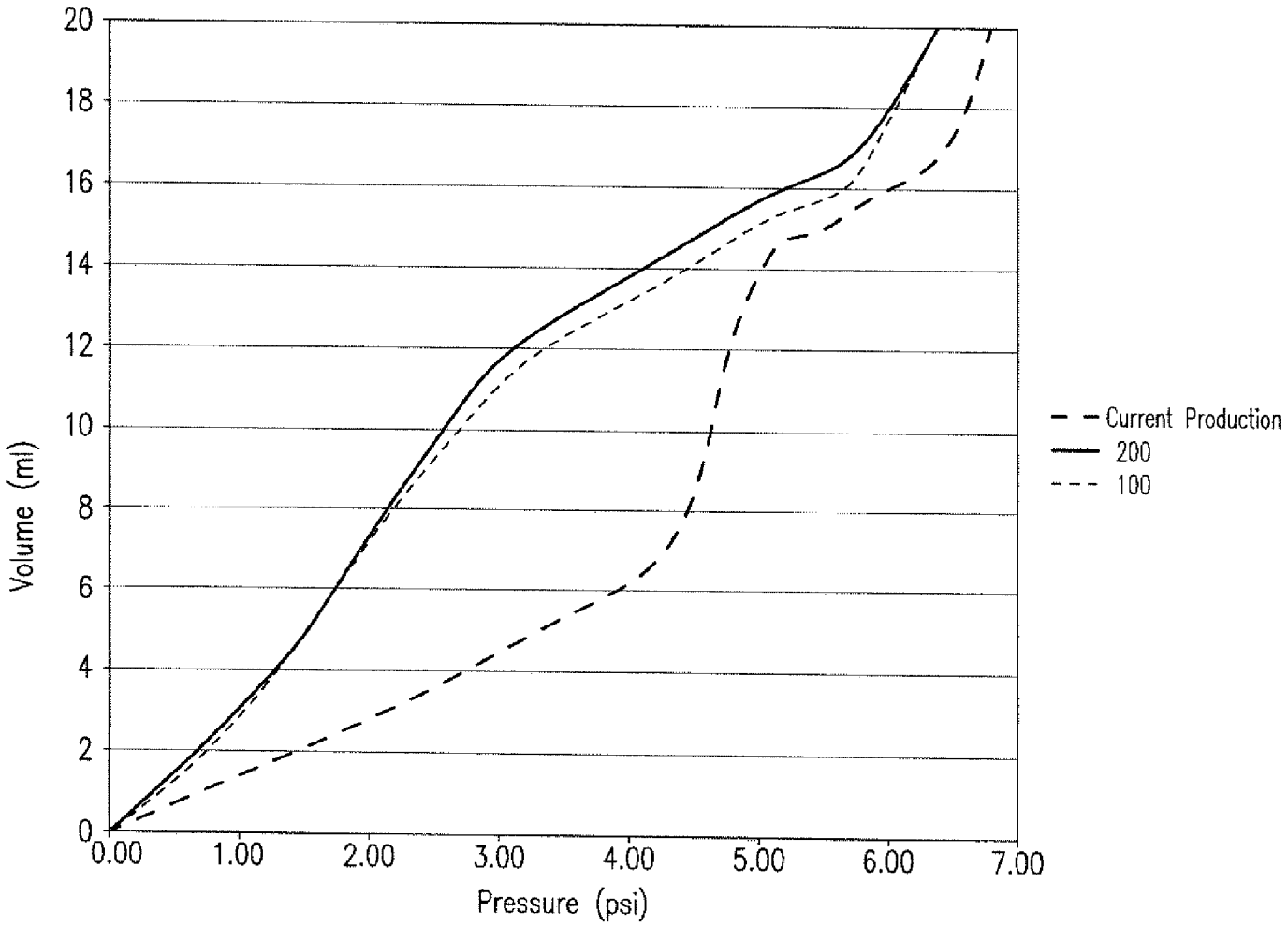
FIG. 16 is a graph illustrating the volume displacement response over a range of pressures for bottles having bases of each of the embodiments of FIG. 1 and FIG. 4 as compared to the known current base of FIG. 12.

FIG. 16 shows a graph illustrating the volume displacement response over a range of pressures for bottles having bases of the embodiments of FIG. 1 (ref. 100) and FIG. 4 (ref. 200) as compared to the known current base of FIG. 12 (ref. Current Production). FIG. 16 illustrates a simulated volume displacement of each base increasing from an initial reference position over a range of applied vacuum pressure. As shown in FIG. 16, the embodiments of the disclosed subject matter exhibit a relatively uniform, linear displacement under applied vacuum pressure compared to the known current base.

Figure 17:
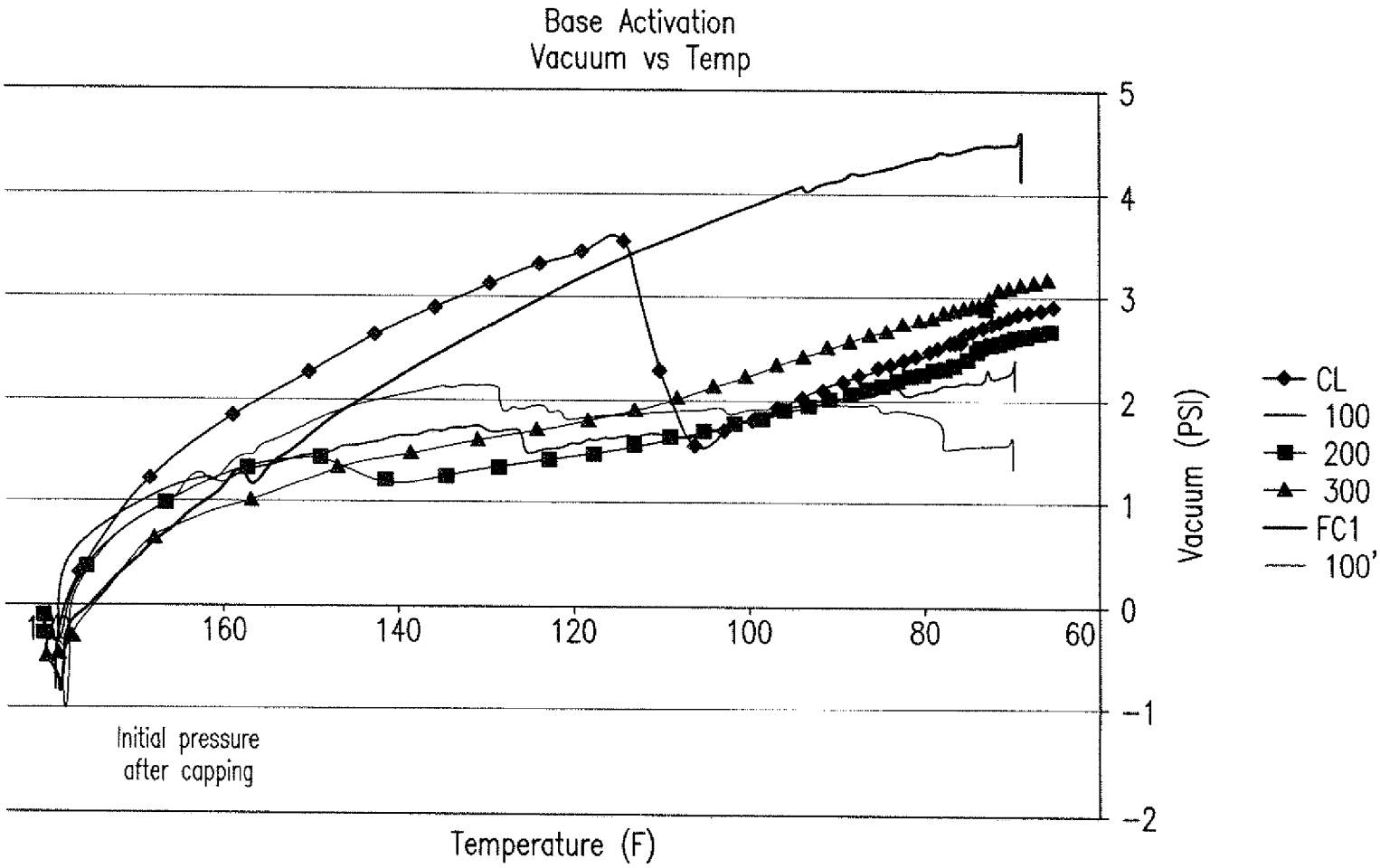
FIG. 17 is a graph of the internal vacuum over a range of decreasing temperatures in a container having bases of each of the embodiments of FIG. 1, FIG. 4, and FIG. 7 as compared to the known current base of FIG. 12.

FIG. 17 shows a graph of the internal vacuum over a range of decreasing temperatures in a container having bases of the embodiments of FIG. 1 (refs. 100, 100'), FIG. 4 (ref. 200), and FIG. 7 (ref. 300) as compared to the known current base of FIG. 12 (refs. CL, FC1). FIG. 17 illustrates relative internal vacuum pressure data measured over a decreasing range of temperatures of the bottles after being filled with hot water and capped. As shown in FIG. 17, the embodiments of the disclosed subject matter exhibit a lower internal vacuum pressure due to the cooling of the liquid contents compared to the known current bases. As compared to the discontinuity shown in the current base CL at about 115-105 degrees F., which can be considered as a base activation point, the embodiments of the disclosed subject matter exhibit a more uniform, linear vacuum pressure in response to the liquid cooling. The base activation points of the exemplary embodiments, shown at about 125 degrees F. in 100 and 100' and 145 degrees F. in 200, occur at higher temperatures and result in less discontinuity in the vacuum pressure as compared to the known current base. FC1 exhibits a known current base on a production line that did not activate.

Figure 18:
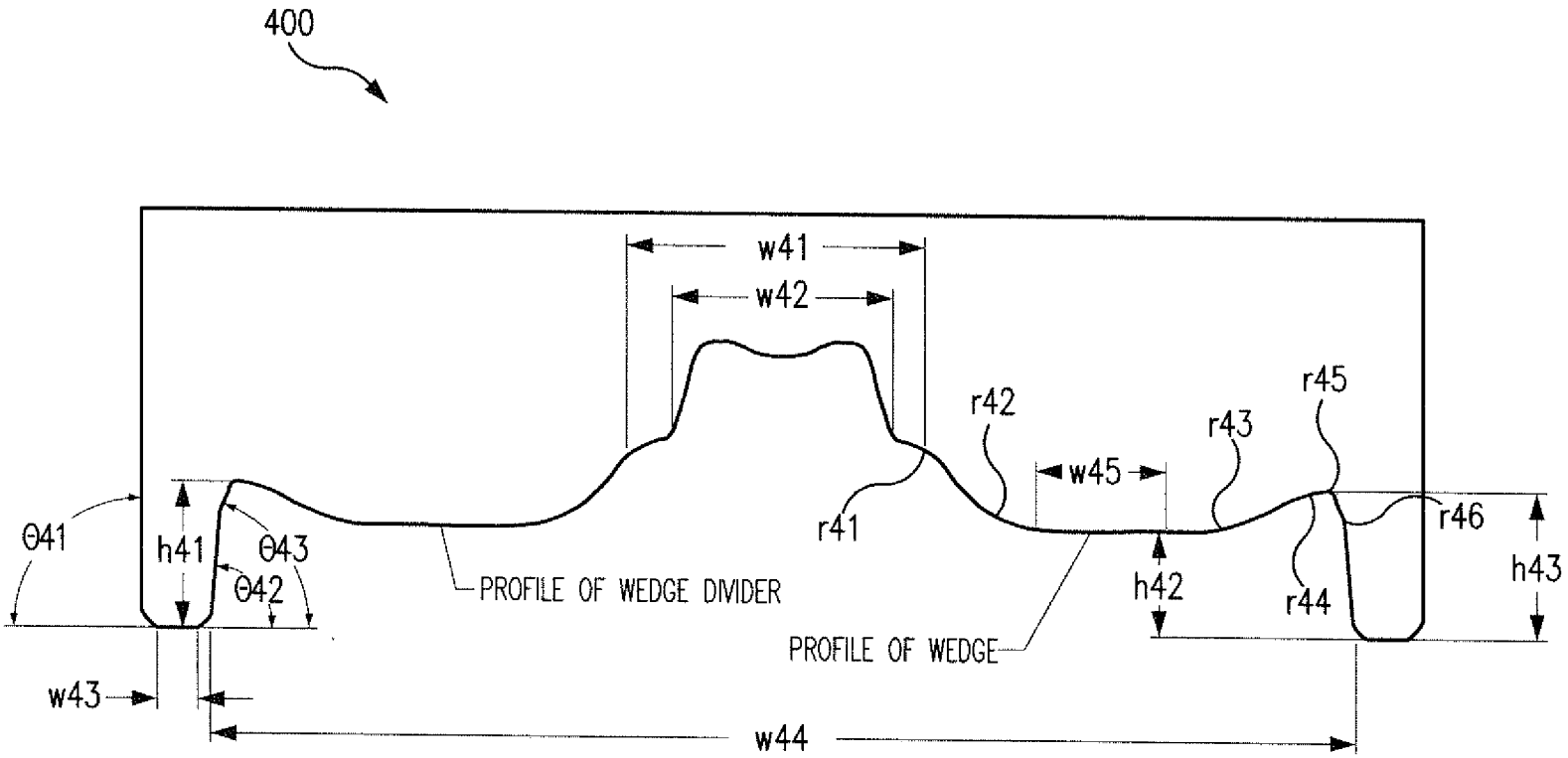
FIG. 18 is a front, cross-sectional schematic view of another exemplary embodiment a base in accordance with the disclosed subject matter.
Figure 19:
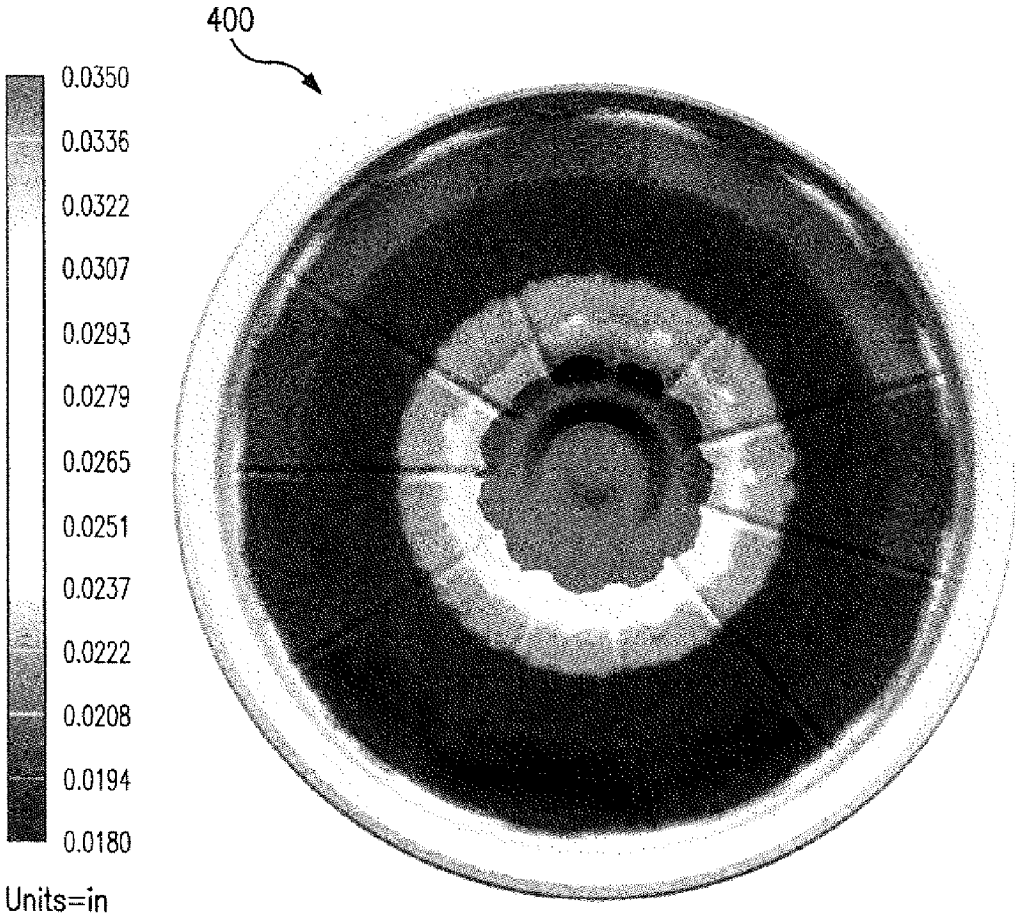
FIG. 19 is a bottom view of the exemplary embodiment of FIG. 18, illustrating the thickness of the base at various points.

FIGS. 18 and 19 illustrate yet another exemplary embodiment in accordance with the disclosed subject matter having different dimensions. FIG. 18 shows a front, cross-sectional schematic view of the exemplary embodiment of a base 400. FIG. 19 shows a bottom view of the exemplary embodiment of FIG. 18, illustrating the thickness of the base at various points.

Figure 20:
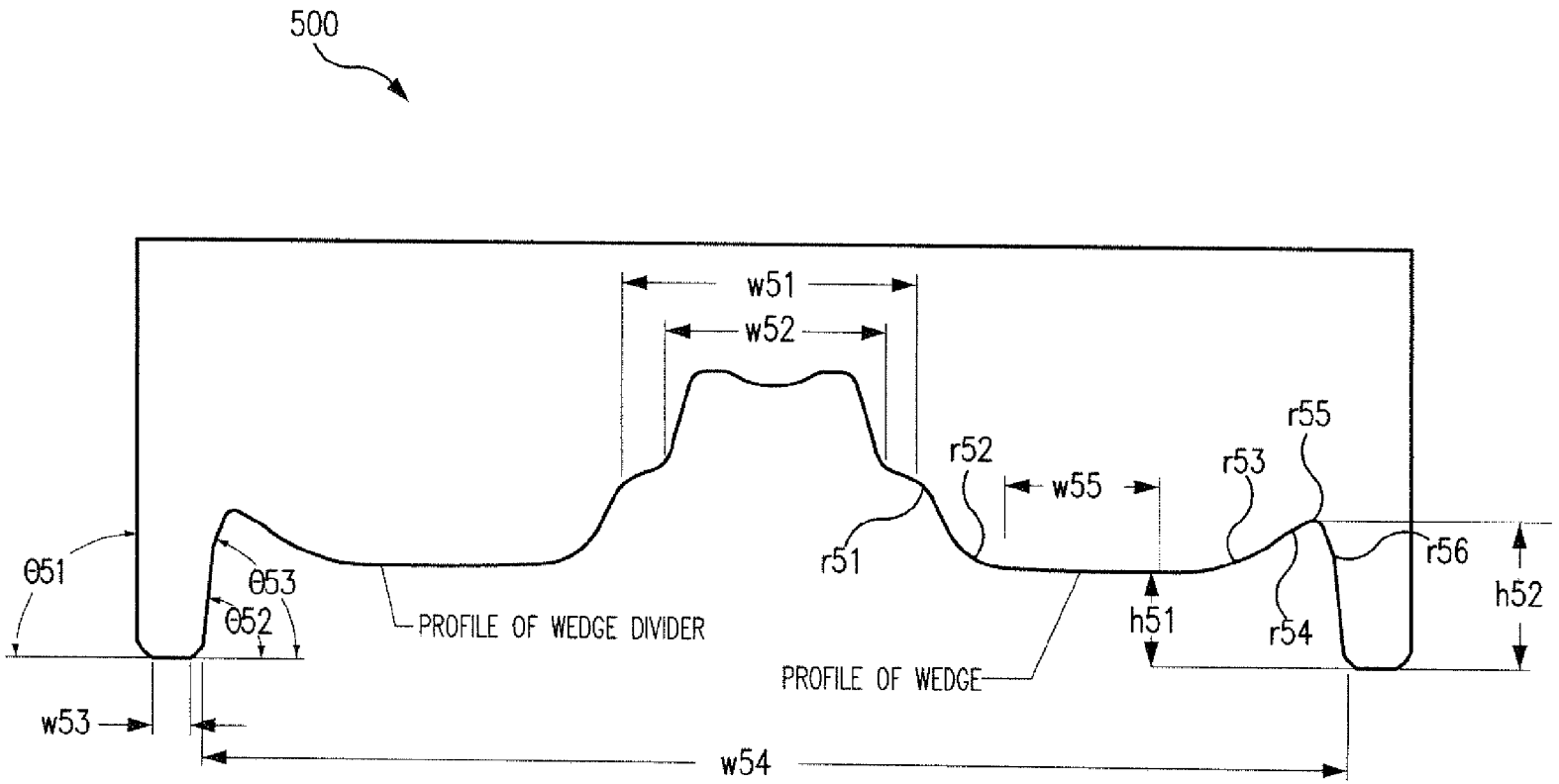
FIG. 20 is a front, cross-sectional schematic view of another exemplary embodiment of a base in accordance with the disclosed subject matter.
Figure 21:
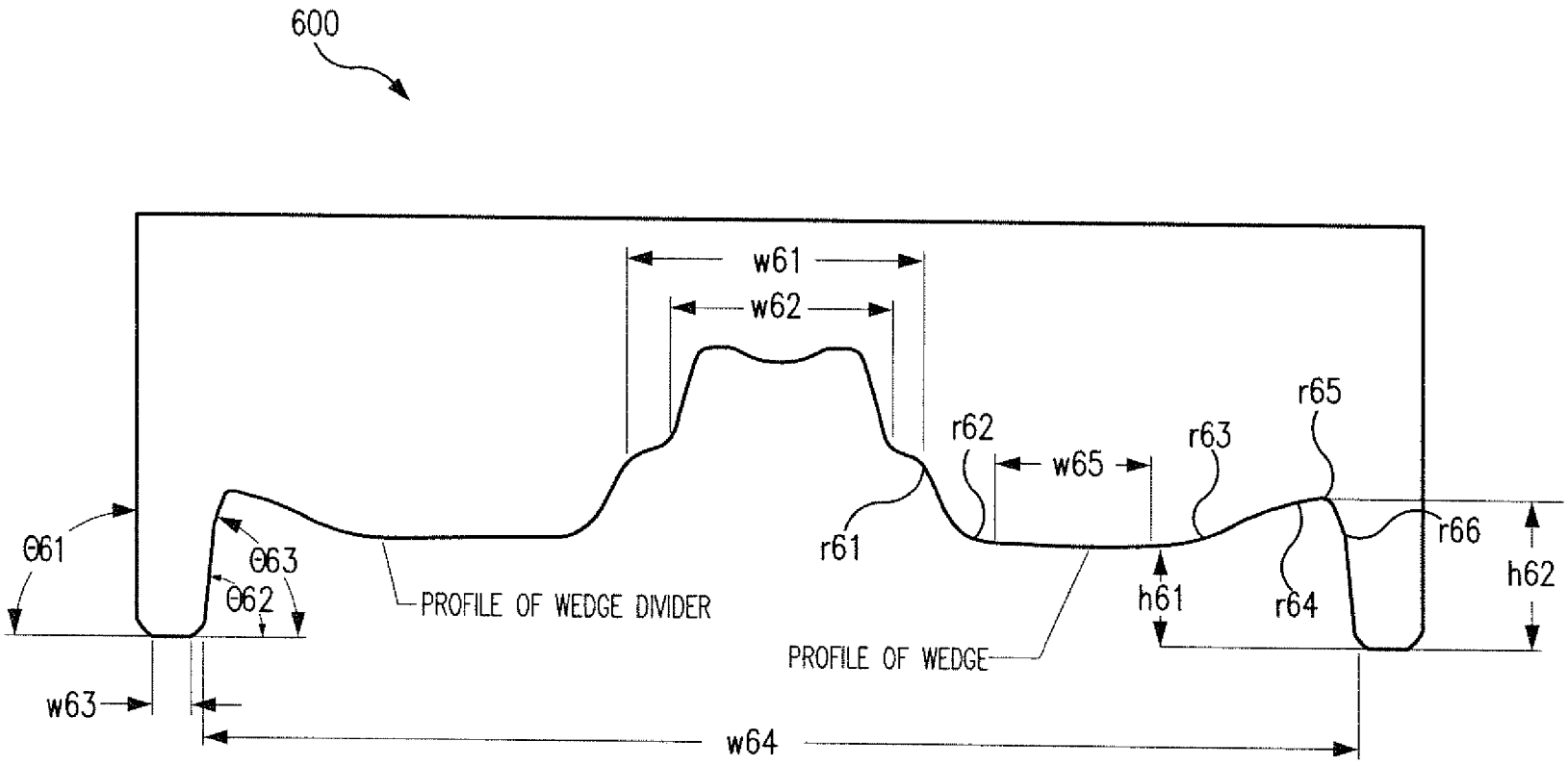
FIG. 21 is a front, cross-sectional schematic view of another exemplary embodiment of a base in accordance with the disclosed subject matter.

FIGS. 20 and 21 each shows a front, cross-sectional schematic view of yet another exemplary embodiment of a base 500, 600 in accordance with the disclosed subject matter having different dimensions.

For purpose of illustration and not limitation, exemplary dimensions and angles shown in FIGS. 1, 4, 7, 18, 20 and 21 are provided in Table 1. However, it will be apparent to those skilled in the art that various modifications and variations to the exemplary dimensions and angles can be made without departing from the spirit or scope of the disclosed subject matter.

Figure 22:
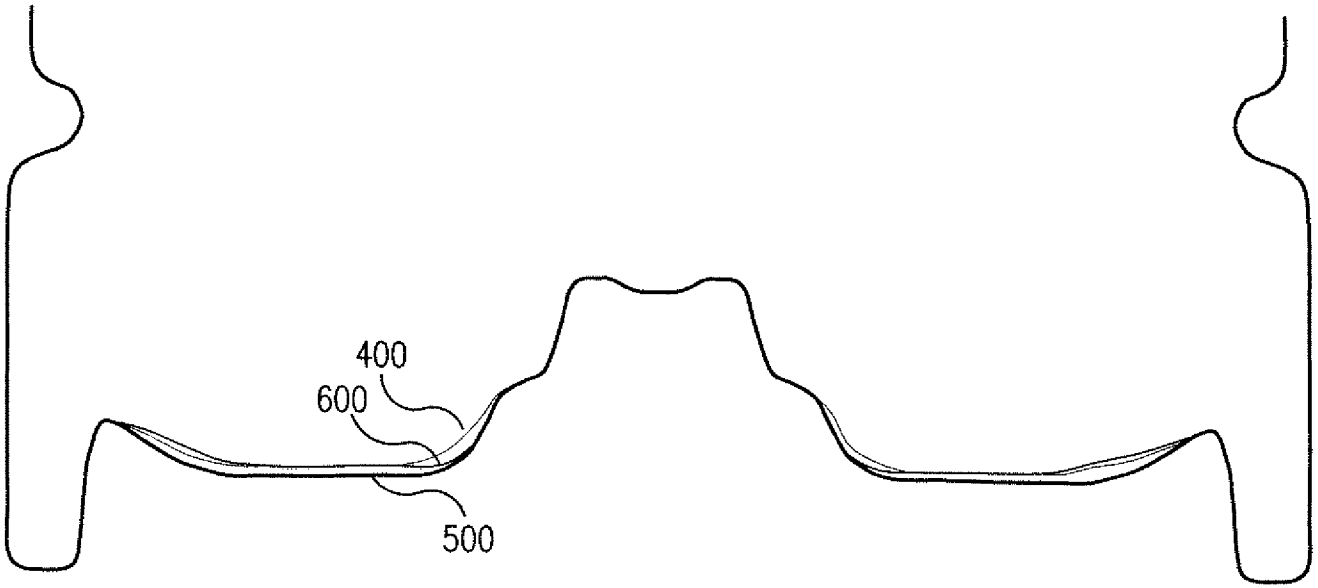
FIG. 22 is a front, cross-sectional schematic view of each of the exemplary embodiments of FIGS. 18-21 overlaid on each other, for purpose of comparison.
Figure 23A:
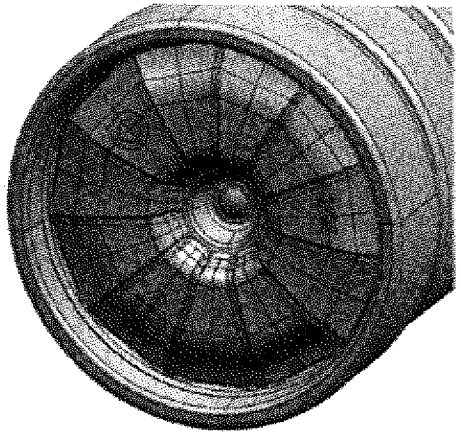
FIGS. 23A-23C each is a bottom perspective view of the exemplary embodiments shown in FIGS. 18-21, shown side-by-side for purpose of comparison.
Figure 23B:
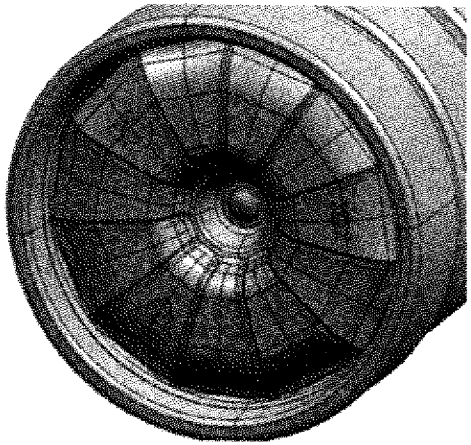
Figure 23C:
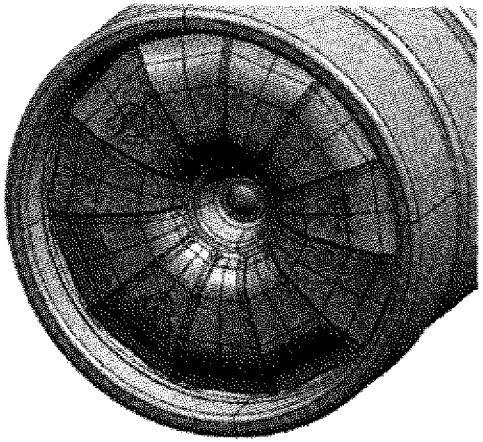

FIG. 22 shows front, cross-sectional schematic views of the exemplary embodiments of FIGS. 18-21 overlaid on each other, for purpose of comparison. FIGS. 23A-23C show bottom perspective views of the exemplary embodiments shown in FIGS. 18-21, shown side-by-side for purpose of comparison. FIG. 23A shows a bottom perspective view of the embodiment of FIG. 21. FIG. 23B shows a bottom perspective view of the embodiment of FIG. 20. FIG. 23C shows a bottom perspective view of the embodiment of FIG. 18.

Figure 24:
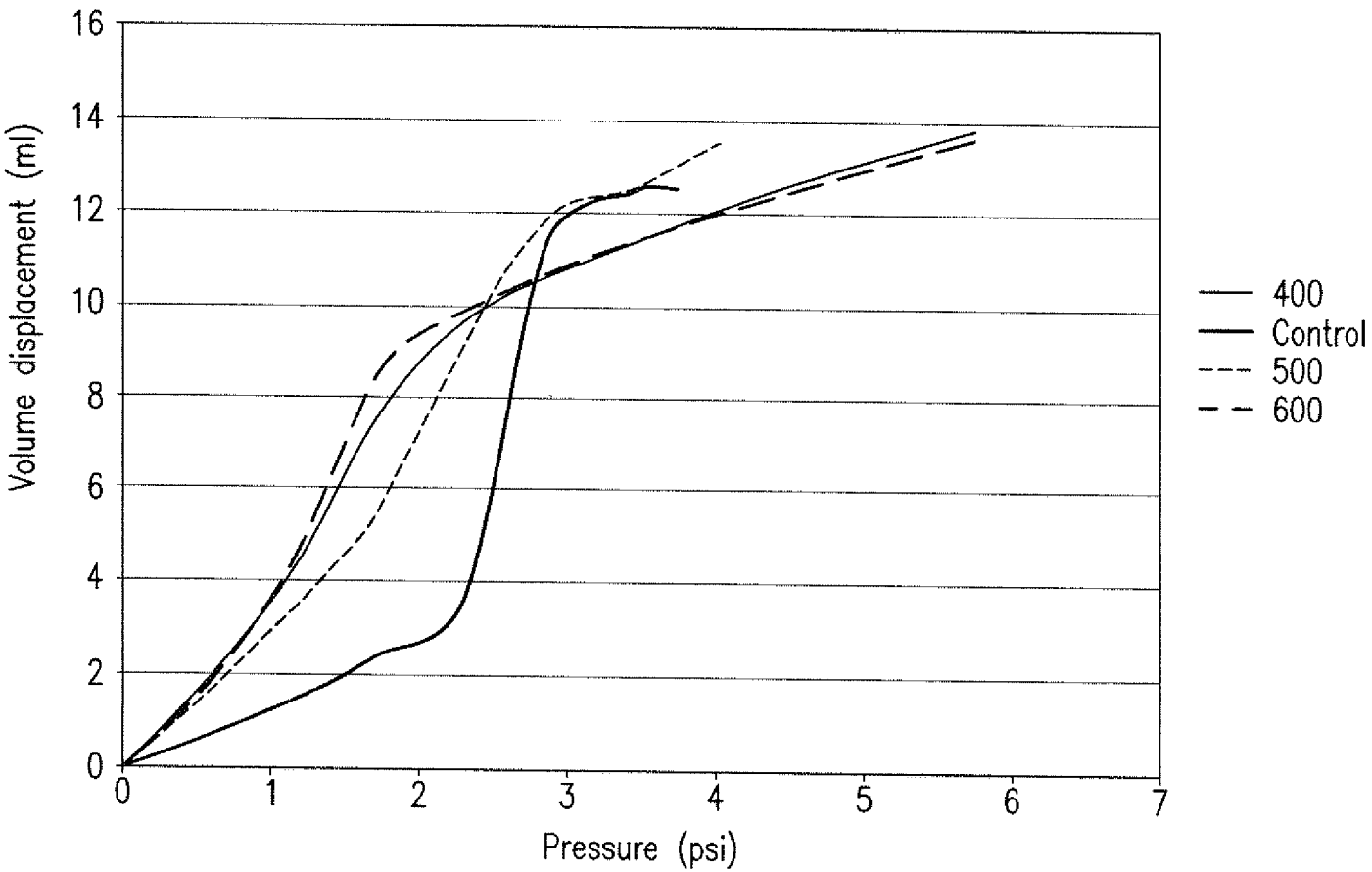
FIG. 24 is a graph illustrating the volume displacement response over a range of pressures for each of the embodiments of FIG. 18, FIG. 20 and FIG. 21 as compared to the known current base of FIG. 12.

FIG. 24 shows a graph illustrating the volume displacement response over a range of pressures for the embodiments of FIG. 18 (ref. 400), FIG. 20 (ref. 500) and FIG. 21 (ref. 600) as compared to the known current base of FIG. 12 (ref. Control). FIG. 24 illustrates a simulated volume displacement of each base increasing from an initial reference position over a range of applied vacuum pressure. As shown in FIG. 24, the embodiments of the disclosed subject matter exhibit a relatively uniform, linear displacement under applied vacuum pressure compared to the known current base.

Figure 25:
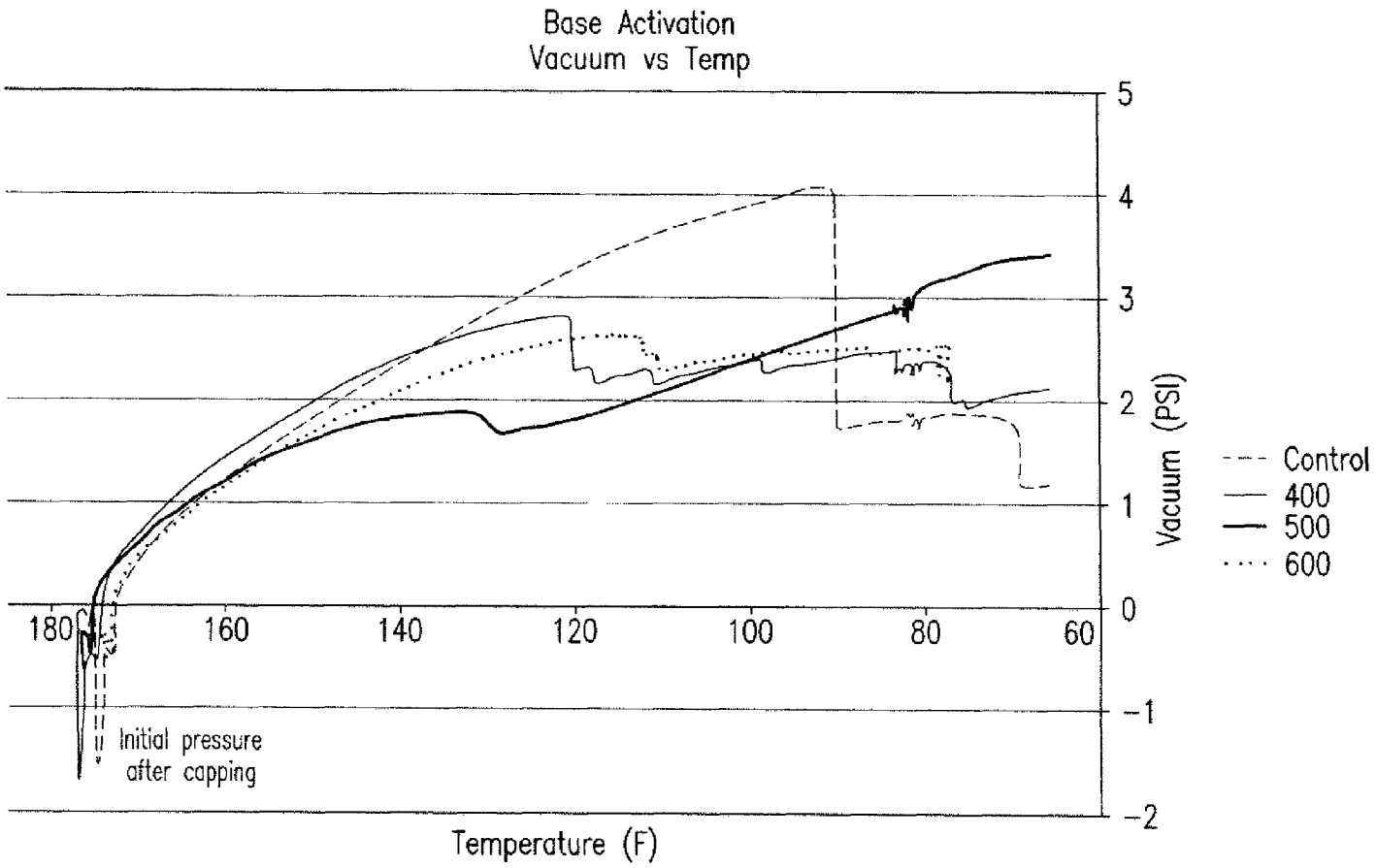
FIG. 25 is a graph of the internal vacuum over a range of decreasing temperatures in a container having bases of each of the embodiments of FIG. 18, FIG. 20, and FIG. 21 as compared to the known current base of FIG. 12.

FIG. 25 shows a graph of the internal vacuum over a range of decreasing temperatures in a container having bases of the embodiments of FIG. 18 (ref. 400), FIG. 20 (ref. 500), and FIG. 21 (ref. 600) as compared to the known current base of FIG. 12 (ref. Control). FIG. 25 illustrates relative internal vacuum pressure data measured over a decreasing range of temperatures of the bottles after being filled with hot water and capped. As shown in FIG. 25, the embodiments of the disclosed subject matter generally exhibit a lower internal vacuum pressure due to the cooling of the liquid contents compared to the known current bases. As compared to the discontinuity shown in the current base Control at about 90 degrees F., which can be considered as a base activation point, the embodiments of the disclosed subject matter exhibit a more uniform, linear vacuum pressure in response to the liquid cooling. The base activation points of the exemplary embodiments, shown at about 120 degrees F. in base 400, 130 degrees F. in base 500 and 110 degrees F. in base 600, occur at higher temperatures and result in less discontinuity in the vacuum pressure as compared to the known current base.

In accordance with another aspect of the disclosed subject matter, a further modification is provided of the base for a container as defined above. That is, the base generally, comprises an outer support wall, a support surface extending inwardly from the outer support wall and defining a reference plane, an inner support wall extending upwardly from the support surface, a first radiused portion extending radially inward from the inner support wall and concave relative to the reference plane, a second radiused portion extending radially inward from the first radiused portion and convex relative to the reference plane, an intermediate surface extending radially inward from the second radiused portion and substantially parallel to the reference plane, a third radiused portion extending radially inward from the intermediate surface and convex relative to the reference plane, and a central portion disposed proximate the third radiused portion as defined in detail above. As disclosed herein, the base further includes a fourth radiused portion disposed between the support surface and the inner support wall and/or a fifth radiused portion disposed between the support surface and the outer support wall. As with the radiused portions previously defined, the fourth radiused portion and the fifth radiused portion herein each generally functions as a hinge for further deformation of the base. Hence, the portion of the base acting as a diaphragm can extend inwardly from the fourth radiused portion to include the inner support wall or inwardly from the fifth radiused portion to further include the support surface.

Figure 27:
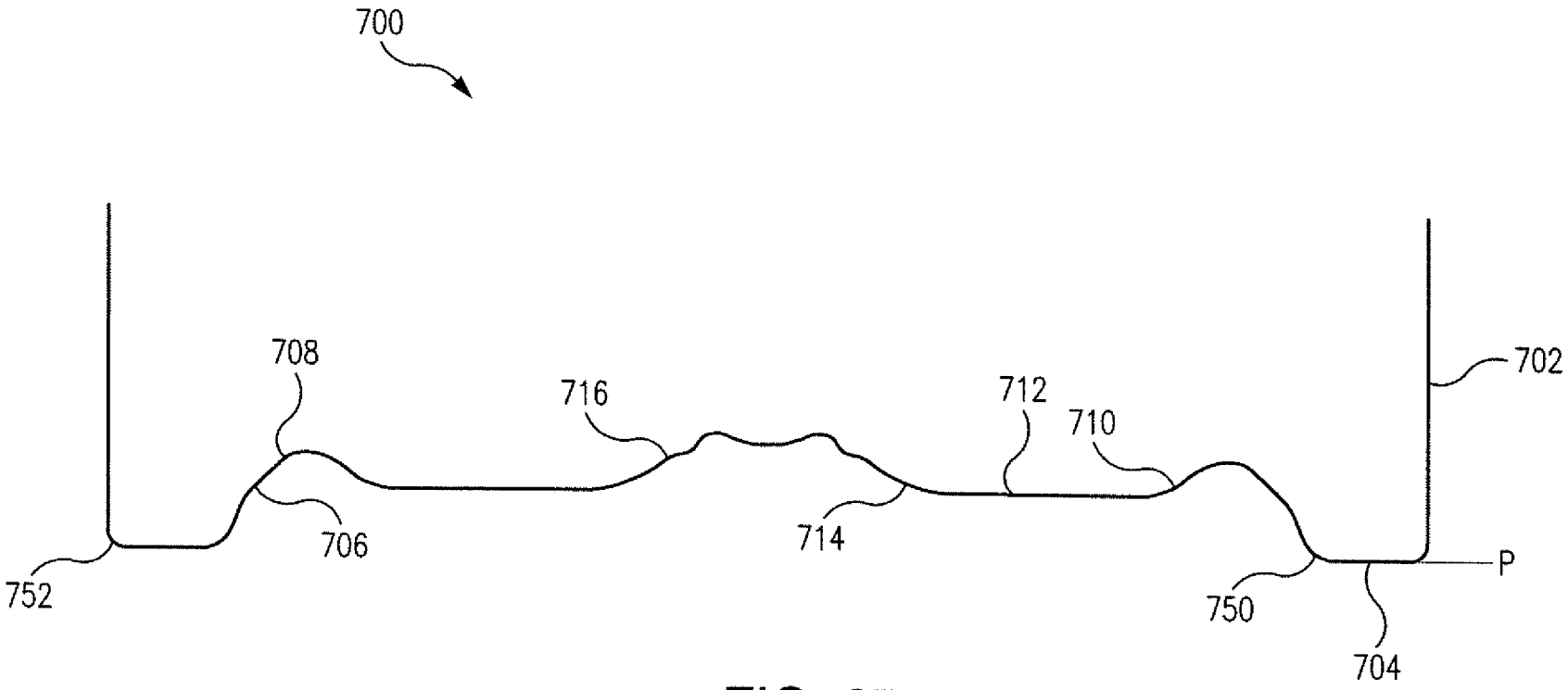
FIG. 27 is a front, cross-sectional schematic view of another exemplary embodiment of a base in accordance with the disclosed subject matter.

For purpose of illustration and not limitation, reference is now made to the exemplary embodiment of FIG. 27. Particularly, FIG. 27 depicts in cross-section the profile of a base 700 having fourth and fifth radiused portions. As depicted in cross-section, the base profile embodied herein generally comprises the various features as described in detail above, including the three radiused portions 708, 710, 714 and intermediate surface 712. Furthermore, a fourth radiused portion 750 is disposed between the support surface 704 and the inner support wall 706 for relative movement therebetween. Additionally or alternatively, a fifth radiused portion 752 can be provided between the support surface 704 and the outer support wall 702. Each of the additional radiused portions can be formed in a variety of ways. As depicted in FIG. 27, the fourth radiused portion 750 is convex when viewed from the bottom, and the inner support wall 706 is configured to extend upward and radially inward from the support surface 704. For example, but not limitation, the inner support wall 706 can be configured such that at least an upper portion thereof extends at an angle of between about 15 degrees and about 85 degrees relative to the reference plane P. Furthermore, and as compared with the embodiment of FIG. 1-3, the support surface 704 can be provided with an increased width in relation to the cross dimension of the base as a whole to enhance the performance of the fifth radiused portion 752 to act as a hinge relative to the outer support wall 702. For example, the support surface 704 can have a width of between about 4% to about 10% of the maximum cross-dimension of the base 700.

In this manner, and as previously described, the radiused portions will function as hinges and can cooperate for dynamic movement of the base as a whole. That is, by providing the fourth radiused portion 750 at the inner edge of the support surface 704, the portion of the base 700 extending inwardly from the fourth radiused portion 750 will act as a diaphragm. Similarly, by providing a fifth radiused portion 752 at the outer support wall 702, the portion of the base 700 extending inwardly from the fifth radiused portion 752 will act as a diaphragm. Depending upon the dimensions of the support surface 704, the diaphragm therefore can comprise at least about 90% of the surface area of the base 700, or even at least about 95% of the surface area.

Furthermore, and as described above, the dimensions and angles of the various features can be selected to tailor the overall performance of the base as desired. For example, the radius and angle of curvature of the various radiused portions, the distances therebetween, and the lengths of the support walls and surfaces can be modified to increase or decrease the spring rate or response to pressure differentials to accommodate a range of thermodynamic environments, such as variations in hot-fill filling lines. Additionally, the angle of curvature of the inner support wall 706 relative to the reference plane P defined by the support surface 704 can be selected for the desired response to pressure differentials to affect the efficiency of the base deformation.

Figure 28:
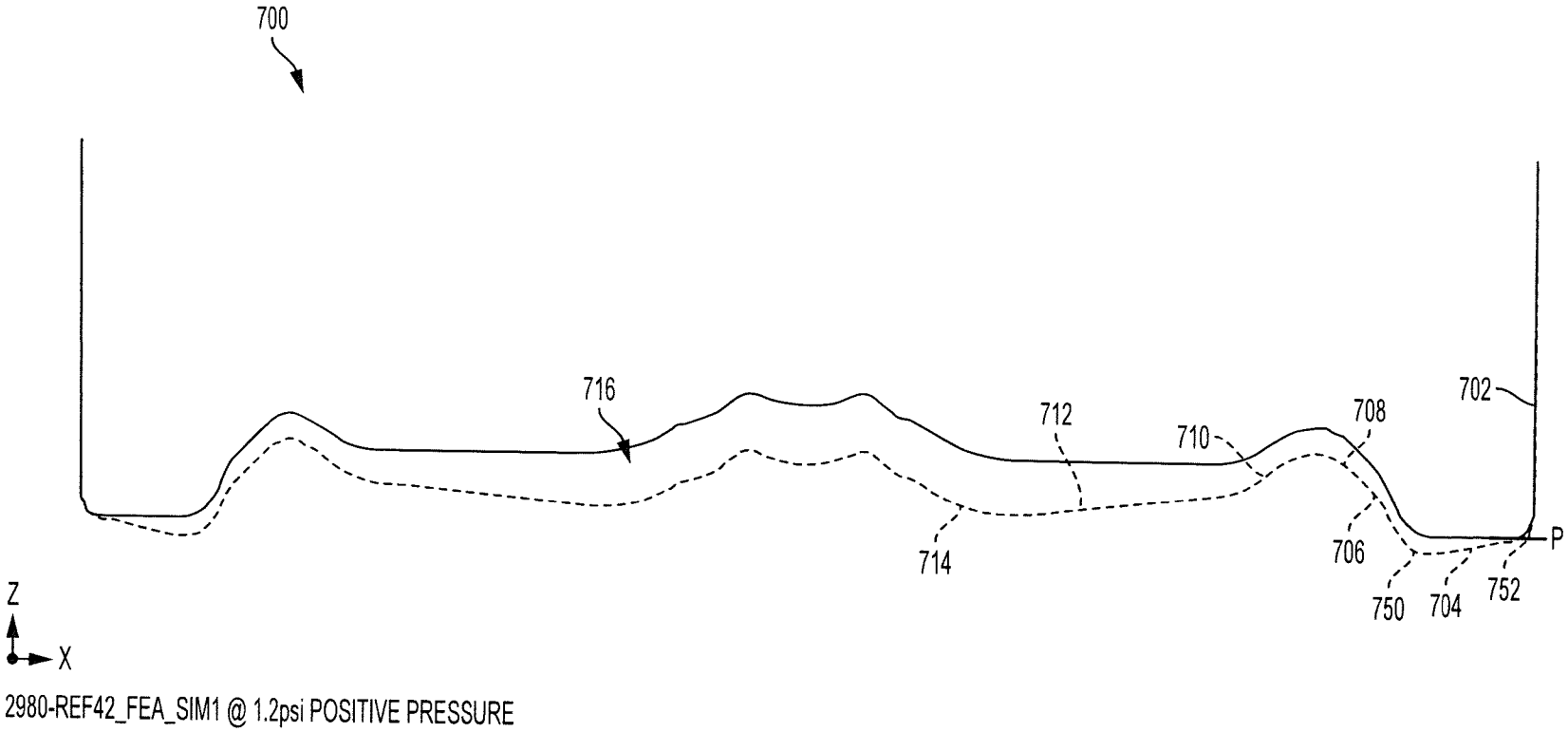
FIG. 28 is a schematic diagram illustrating additional features of the operation of the exemplary embodiment of FIG. 27.
Figure 29:
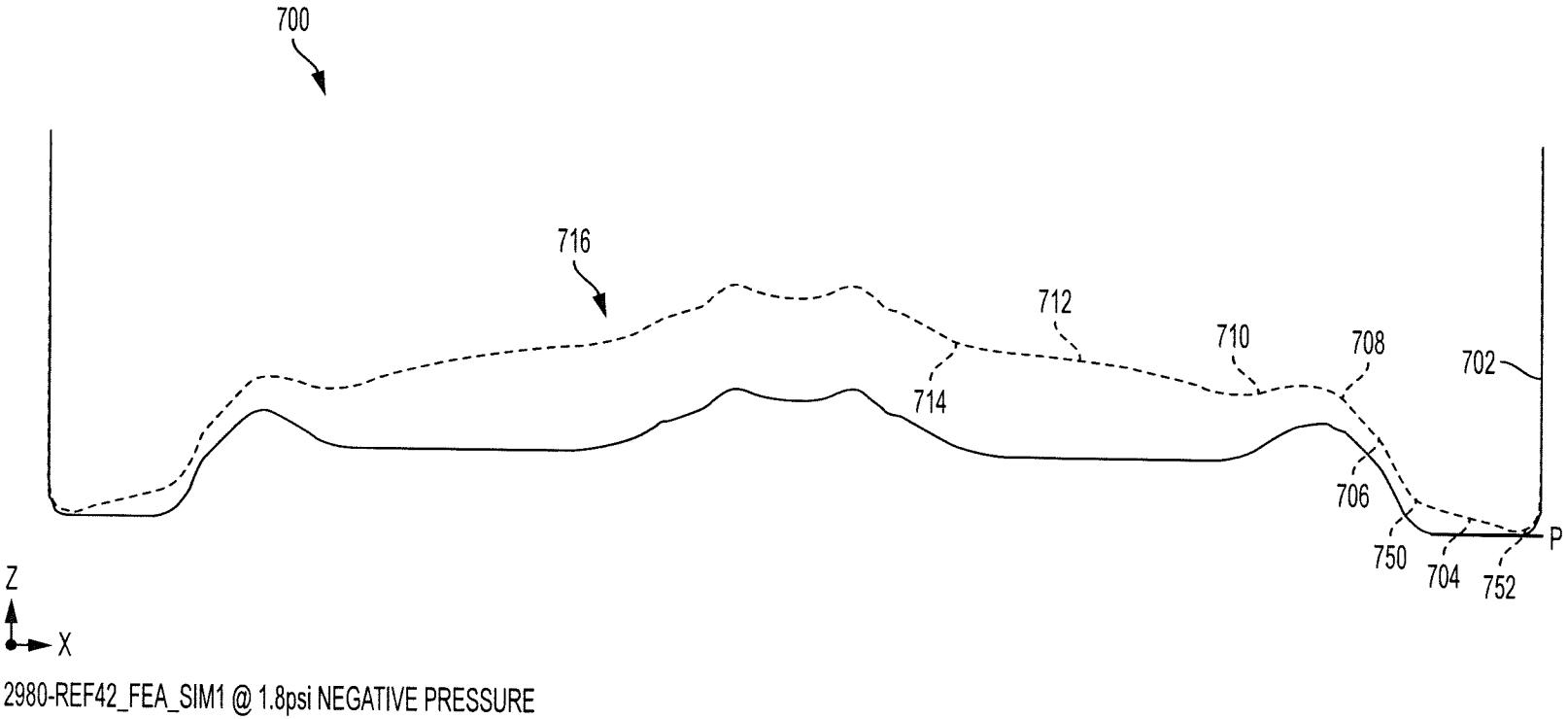
FIG. 29 is a schematic diagram illustrating additional features of the operation of the exemplary embodiment of FIG. 27.

Operation of an exemplary base 700 further having fourth and fifth radiused portions 750, 752 is illustrated schematically with reference to FIGS. 28 and 29. As depicted, operation of base designs having fourth and fifth radiused portions 750, 752 can exhibit base deformation in response to pressure differentials between the container and the environment at the fifth radiused portion 752 proximate the outer wall of the container. Accordingly, in response to a positive pressure differential in the container relative to the environment, the support surface 704 of the base 700 itself can rotate downwards relative to outer support wall 702, and conversely, in response to a negative pressure differential in the container relative to the environment, the support surface 704 can rotate upwards relative to the outer support wall 702.

For example, and as depicted generally in FIG. 28 for purpose of illustration, an increase in pressure within the container will deform the base 700 in a controlled manner such that the fifth radius portion 752 rotates downward relative to the reference plane P (i.e., defined by the support surface when not deflected). That is, and as embodied herein in its initial state, the fifth radiused portion 752 generally defines a right angle or 90° between the support surface 704 and outer support wall 702. Upon an increase in internal pressure, the fifth radiused portion 752 will rotate or open to define an obtuse angle (i.e., greater than 90°). In this manner, as the fifth radiused portion 752 rotates, the standing surface for the container shifts to the inner edge of the support surface 704. As used herein, "standing surface" is the surface that would be in contact with a horizontal surface upon which the base is placed. As shown, however, the radii of the radiused portions 708, 710, 714, 750, 752 and the length of the intermediate surface 712 are selected to cooperate such that the central portion 716 or core does not reside below the standing surface when the maximum desired pressure differential is reached. In a similar fashion, and as shown in FIG. 29, a negative pressure within the container relative the surrounding environment or atmosphere will result in the fifth radiused portion 752 rotating upwardly from the reference plane P to define an acute angle (i.e. less than 90°). As such, the standing surface of the container will shift toward the outer edge of the support surface 704 proximate the outer support wall 702. With reference to the further embodiment disclosed in FIG. 28, the radius portions disposed inwardly of the fifth radius portion 752 can provide additional deformation, which can be approximately 10-20% or more of total base displacement. Hence, and as disclosed herein, the base 700 can be configured such that the support surface 704 can rotate to shift the standing surface toward the inner edge of the support surface 704 proximate the fourth radiused portion 750 when there is a positive pressure differential in the container, and rotate to shift the standing surface to the outer edge of the support surface 704 proximate the fifth radiused portion 752 when there is a negative pressure differential in the container. Throughout operation, the standing surface remains preferably below the remaining portions of the base 700 disposed inwardly of the standing surface.

Particularly, FIGS. 28 and 29 illustrate simulated deformations of base 700 when subject to a range of pressure differentials. FIG. 28 illustrates simulated deformation of base 700 in response to a positive pressures of 1.2 psi. FIG. 29 illustrates simulated deformation of base 700 in response to a negative pressures of 1.8 psi. As shown in FIGS. 28 and 29, the embodiments of the disclosed subject matter exhibit a relatively uniform, linear displacement under applied vacuum pressure compared to the known current base. Additionally, as illustrated, significant displacement occurs at the fifth radiused portion 752, while the portions disposed inwardly of the fourth radiused portion remain 750 above the standing surface.

In accordance with another aspect of the disclosed subject matter, a container is provided having a base as described in detail above. The container generally comprises a sidewall and a base, the base comprising an outer support wall, a support surface extending inwardly from the outer support wall and defining a reference plane, an inner support wall extending upwardly from the support surface, a first radiused portion extending radially inward from the inner support wall and concave relative to the reference plane, a second radiused portion extending radially inward from the first radiused portion and convex relative to the reference plane, an intermediate surface extending radially inward from the second radiused portion and substantially parallel to the reference plane, a third radiused portion extending radially inward from the intermediate surface and convex relative to the reference plane, and a central portion disposed proximate the third radiused portion. As embodied herein, the container sidewall can be coextensive and/or integral with the outer support wall of the base. Other modifications and feature as described above or otherwise known can also be employed.

The various embodiments of the base and of the container as disclosed herein can be formed by conventional molding techniques as known in the industry. For example, the base can be formed by blow-molding with or without a movable cylinder.

Figure 30:
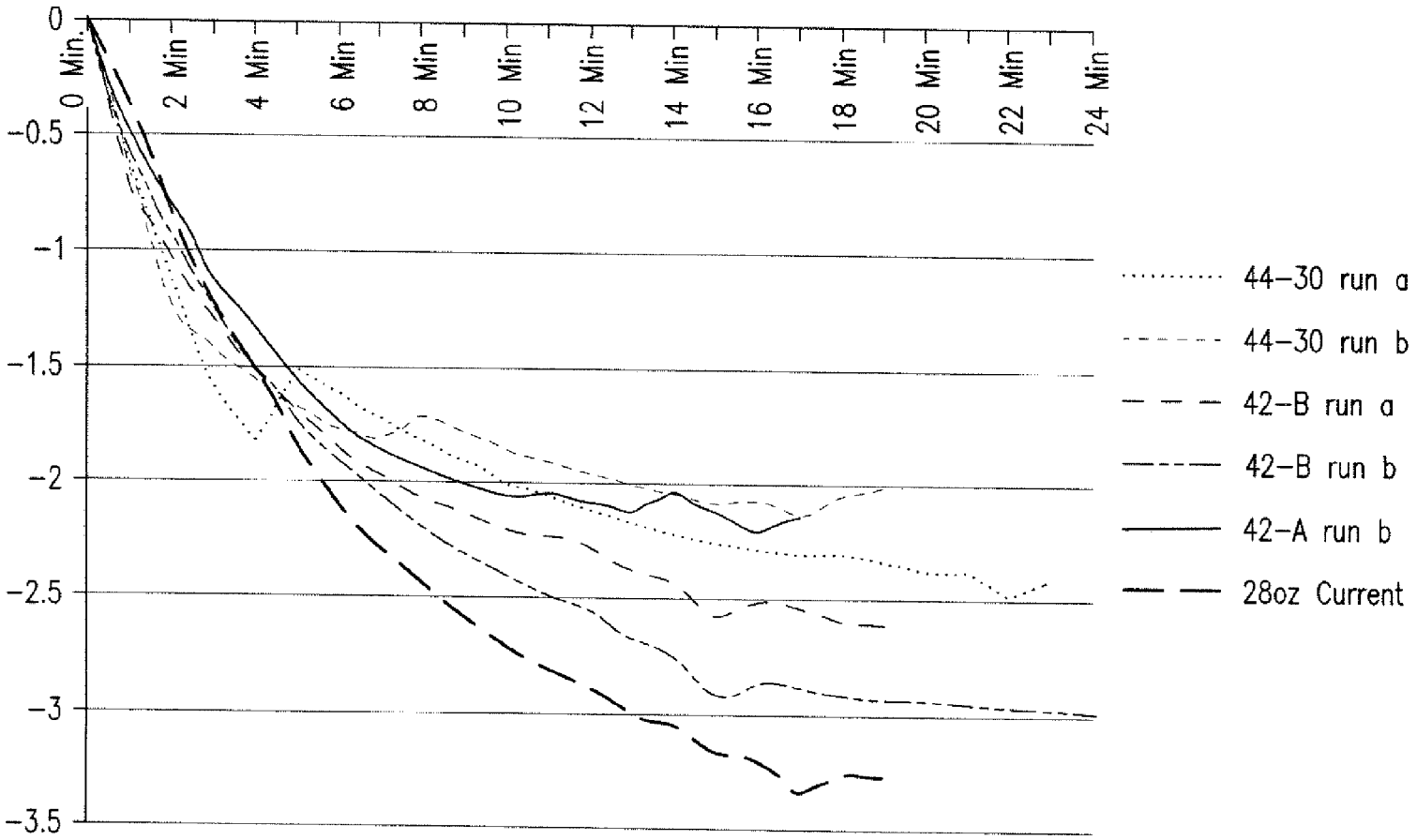
FIG. 30 is a diagram illustrating the rate of volume decrease associated with the decrease in pressure for the containers having a base of the exemplary embodiment of FIG. 27 compared to a container having a base of the exemplary embodiment of FIG. 1.

For purpose of understanding and not limitation, a series of graphs are provided to demonstrate various operational characteristics achieved by the base and container disclosed herein. FIG. 30 shows a graph illustrating the rate of volume decrease associated with the decrease in pressure for the containers having base embodiments as depicted in FIG. 27 compared to a container having a base embodiment as depicted in FIG. 1. Particularly, it is noted that each of the containers were formed of the same materials, dimensions, and processes, and that only the base profiles differ.

In addition to the specific embodiments claimed below, the disclosed subject matter is also directed to other embodiments having any other possible combination of the dependent features claimed below and those disclosed above. As such, the particular features disclosed herein can be combined with each other in other manners within the scope of the disclosed subject matter such that the disclosed subject matter should be recognized as also specifically directed to other embodiments having any other possible combinations. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the method and system of the disclosed subject matter without departing from the spirit or scope of the disclosed subject matter. Thus, it is intended that the disclosed subject matter include modifications and variations that are within the scope of the appended claims and their equivalents.

TABLE 1

Exemplary Dimensions

| Dimension | Length in Inches (Millimeters) |
|---|---|
| h11 | 0.318 (8.09) |
| h12 | 0.228 (5.78) |
| h13 | 0.328 (8.34) |
| w11 | 0.633 (16.08) |
| w12 | 0.468 (11.90) |
| w13 | 0.062 (1.57) |
| w14 | 2.575 (65.41) |
| w15 | 0.270 (6.85) |
| h21 | 0.199 (5.06) |
| h22 | 0.504 (12.80) |
| h23 | 0.108 (2.73) |
| h24 | 0.207 (5.27) |
| w21 | 0.607 (15.42) |
| w22 | 0.488 (11.90) |
| w23 | 0.062 (1.57) |
| w24 | 0.278 (7.06) |
| w25 | 2.591 (65.81) |
| h31 | 0.206 (5.24) |
| h32 | 0.306 (7.77) |
| w31 | 0.801 (20.34) |
| w32 | 0.714 (19.14) |
| w33 | 0.606 (15.38) |
| w34 | 0.062 (1.57) |
| w35 | 0.040 (1.02) |
| w36 | 0.094 (2.38) |
| w37 | 0.270 (6.85) |
| w38 | 0.040 (1.02) |
| w39 | 0.029 (0.74) |
| w310 | 0.045 (1.14) |
| w311 | 2.575 (65.41) |
| h41 | 0.311 (7.91) |
| h42 | 0.219 (5.57) |
| h43 | 0.320 (8.12) |
| w41 | 0.633 (16.07) |
| w42 | 0.468 (11.90) |
| w43 | 0.062 (1.57) |
| w44 | 2.441 (62.01) |
| w45 | 0.278 (7.06) |
| h51 | 0.199 (5.06) |
| h52 | 0.320 (8.12) |
| w51 | 0.629 (15.97) |
| w52 | 0.468 (11.90) |
| w53 | 0.062 (1.57) |
| w54 | 2.441 (62.01) |
| w55 | 0.328 (8.33) |
| h61 | 0.219 (5.57) |
| h62 | 0.320 (8.12) |
| w61 | 0.629 (15.97) |
| w62 | 0.468 (11.90) |
| w63 | 0.062 (1.57) |
| w64 | 2.441 (62.01) |
| w65 | 0.328 (8.34) |

| Dimension | Radius of Curvature in Inches (Millimeters) |
|---|---|
| r11 | 0.060 (1.52) |
| r12 | 0.368 (9.36) |
| r13 | 0.358 (9.09) |
| r14 | 0.347 (8.81) |
| r15 | 0.040 (1.02) |
| r16 | 0.041 (1.03) |
| r21 | 0.420 (10.68) |
| r22 | 0.357 (9.08) |
| r23 | 0.039 (1.00) |
| r24 | 0.100 (2.54) |
| r25 | 0.388 (9.35) |
| r26 | 0.357 (9.08) |
| r27 | 0.420 (10.68) |
| r28 | 0.040 (1.02) |

TABLE 1-continued

| Exemplary Dimensions | |
|---|---|
| r31 | 0.100 (2.54) |
| r32 | 0.138 (3.51) |
| r33 | 0.403 (10.23) |
| r34 | 0.357 (9.08) |
| r35 | 0.060 (1.52) |
| r36 | 0.040 (1.02) |
| r41 | 0.060 (1.52) |
| r42 | 0.224 (5.70) |
| r43 | 0.358 (9.09) |
| r44 | 0.352 (8.94) |
| r45 | 0.040 (1.02) |
| r46 | 0.041 (1.03) |
| r51 | 0.060 (1.52) |
| r52 | 0.154 (3.90) |
| r53 | 0.358 (9.09) |
| r54 | 0.182 (4.61) |
| r55 | 0.040 (1.02) |
| r56 | 0.041 (1.03) |
| r61 | 0.060 (1.52) |
| r62 | 0.119 (3.03) |
| r63 | 0.358 (9.09) |
| r64 | 0.541 (13.75) |
| r65 | 0.040 (1.02) |
| r66 | 0.041 (1.03) |
| **Angle** | **Degrees** |
| Θ11 | 90 |
| Θ12 | 85 |
| Θ13 | 70 |
| Θ21 | 90 |
| Θ22 | 74 |
| Θ23 | 20 |
| Θ31 | 90 |
| Θ32 | 20 |
| Θ41 | 90 |
| Θ42 | 85 |
| Θ43 | 70 |
| Θ51 | 90 |
| Θ52 | 85 |
| Θ53 | 70 |
| Θ61 | 90 |
| Θ62 | 85 |
| Θ63 | 70 |

The invention claimed is:

1. A base for a container, the base comprising:

an outer support wall having a central longitudinal axis;

a support surface extending inwardly toward the central longitudinal axis from the outer support wall and defining a reference plane;

an inner support wall extending upwardly from the support surface;

a first radiused portion extending radially inward toward the central longitudinal axis from the inner support wall and concave relative to the reference plane;

a second radiused portion extending radially inward toward the central longitudinal axis from the first radiused portion and convex relative to the reference plane;

an intermediate surface extending radially inward toward the central longitudinal axis from the second radiused portion and substantially parallel to the reference plane;

a third radiused portion extending radially inward toward the central longitudinal axis from the intermediate surface and convex relative to the reference plane;

a central portion disposed proximate the third radiused portion, the central portion including an inner core having a frustoconical sidewall; and a transition portion having an arcuate cross-section between the third radiused portion and the inner core, the frustoconical sidewall extending at an angle from the transition portion.

2. The base of claim 1, further comprising a fourth radiused portion disposed between the support surface and the inner support wall.

3. The base of claim 2, wherein a diaphragm is defined inwardly from the fourth radiused portion.

4. The base of claim 3, wherein the diaphragm comprises at least about 90% of the surface area of the base.

5. The base of claim 2, further comprising a fifth radiused portion disposed between the support surface and the outer support wall.

6. The base of claim 5, wherein a diaphragm is defined inwardly toward the central longitudinal axis from the fifth radiused portion.

7. The base of claim 6, wherein the diaphragm comprises about 95% of the surface area of the base.

8. The base of claim 1, wherein the inner core further comprises a top surface extending from the frustoconical sidewall, the top wall having a convex portion relative the reference plane.

9. The base of claim 1, further comprising a plurality of ribs extending from the central portion to the support surface and spaced apart to define a plurality of segments between the central portion and the support surface.

10. The base of claim 1, wherein the support surface has a width of between about 4% to about 10% the width of the maximum cross-dimension of the base.

11. The base of claim 1, wherein at least an upper section of the inner support wall extends inwardly at an angle of between about 15 degrees to about 85 degrees relative the reference plane.

12. The base of claim 1, wherein the third radiused portion has a radius of curvature between about 0.119 inches to 0.403 inches.

13. A container comprising:

a sidewall; and a base comprising:

an outer support wall having a central longitudinal axis;

a support surface extending inwardly toward the central longitudinal axis from the outer support wall and defining a reference plane;

an inner support wall extending upwardly from the support surface;

a first radiused portion extending radially inward toward the central longitudinal axis from the inner support wall and concave relative to the reference plane;

a second radiused portion extending radially inward toward the central longitudinal axis from the first radiused portion and convex relative to the reference plane;

an intermediate surface extending radially inward toward the central longitudinal axis from the second radiused portion and substantially parallel to the reference plane;

a third radiused portion extending radially inward toward the central longitudinal axis from the intermediate surface and convex relative to the reference plane;

a central portion disposed proximate the third radiused portion, the central portion including an inner core having a frustoconical sidewall; and a transition portion having an arcuate cross-section between the third radiused portion and the inner core, the frustoconical sidewall extending at an angle from the transition portion.

14. The container of claim 13, wherein the base further comprises a fourth radiused portion disposed between the support surface and the inner support wall.

15. The container of claim 14, wherein a diaphragm is defined inwardly from the fourth radiused portion of the base.

16. The container of claim 15, wherein the diaphragm comprises at least about 90% of the surface area of the base.

17. The container of claim 13, wherein the base further comprises a fifth radiused portion disposed between the support surface and the outer support wall.

18. The container of claim 17, wherein a diaphragm is defined inwardly toward the central longitudinal axis from the fifth radiused portion of the base.

19. The container of claim 18, wherein the diaphragm comprises about 95% of the surface area of the base.

20. The container of claim 13, wherein the inner core further comprises a top surface extending from the frustoconical sidewall, the top surface having a convex portion relative the reference plane.

21. The container of claim 13, further comprising a plurality of ribs between the central portion to the support surface and spaced apart to define a plurality of segments between the central portion and the support surface.

22. The container of claim 21, wherein the support surface has a width of between about 4% to about 10% the width of the maximum cross-dimension of the base.

23. The container of claim 13, wherein at least an upper section of the inner support wall extends inwardly at an angle of between about 15 degrees to about 85 degrees relative the reference plane.

24. The container of claim 13, wherein the third radiused portion has a radius of curvature between about 0.119 inches to 0.403 inches.

* * * * *